US011814799B2

(12) United States Patent
Lapalme et al.

(10) Patent No.: US 11,814,799 B2
(45) Date of Patent: Nov. 14, 2023

(54) FIRE HYDRANT SWEEPING MACHINE

(71) Applicant: EDDYNET INC., Saint-Rémi-de-Tingwick (CA)

(72) Inventors: Eric Lapalme, Varennes (CA); Marc Bouchard, Saint-Bruno-de-Montarville (CA); René Bellerose, Sherbrooke (CA); Sébastien Gagnon, St-Christophe-d'Arthabaska (CA)

(73) Assignee: EDDYNET INC., Saint-Rémi-de-Tingwick (CA)

( * ) Notice: Subject to any disclaimer, the term of this patent is extended or adjusted under 35 U.S.C. 154(b) by 243 days.

(21) Appl. No.: 16/868,508

(22) Filed: May 6, 2020

(65) Prior Publication Data

US 2020/0354909 A1 Nov. 12, 2020

Related U.S. Application Data

(60) Provisional application No. 62/845,636, filed on May 9, 2019.

(51) Int. Cl.

| | |
|---|---|
| ***E01H 1/05*** | (2006.01) |
| ***E01H 1/00*** | (2006.01) |
| ***E01H 1/04*** | (2006.01) |

(52) U.S. Cl.

CPC ..... *E01H 1/056* (2013.01); *E01H 1/005* (2013.01); *E01H 1/042* (2013.01)

(58) Field of Classification Search

CPC ..... E01H 5/065; E01H 5/066; E01H 5/076; E01H 5/08; E01H 5/092; E01H 5/098;

(Continued)

(56) References Cited

U.S. PATENT DOCUMENTS

| | | | |
|---|---|---|---|
| 2,601,695 | A | 7/1952 | Grace |
| 2,945,254 | A | 7/1960 | Boissonnault |

(Continued)

FOREIGN PATENT DOCUMENTS

| | | |
|---|---|---|
| CN | 105562379 | 1/2016 |
| DE | 3928914 | 3/1991 |

(Continued)

OTHER PUBLICATIONS

Translation of JPH07310310A, retrieved from Espacenet on Jan. 25, 2023 (Year: 1995).*

*Primary Examiner* — Thomas Raymond Rodgers

(74) *Attorney, Agent, or Firm* — BENOIT & COTE INC.; Charles-Andre Caron; Mathieu Audet

(57) ABSTRACT

A sweeping machine for mounting to a blower is adapted for sweeping debris, e.g., snow, from an area around an obstacle, e.g., fire hydrant. The sweeping machine comprises a rotating brush having an axis of rotation which is horizontal, a frame for the rotating brush, an arm extending from a proximal end to a distal end to which the frame is secured, a blower, and a pivoting mechanism secured to the blower. The pivoting mechanism is adapted to swivel the arm upwardly to lift the rotating brush and to swivel the arm within a horizontal plane to move the rotating brush horizontally relative to the blower. Thereby, the sweeping machine is adapted to sweep debris from the area around the obstacle by the rotating brush toward the blower which is itself adapted to blow the debris away from the obstacle.

20 Claims, 21 Drawing Sheets

(58) Field of Classification Search
CPC .. E01H 5/12; E01H 8/06; E01H 1/056; E01H 1/005; E01H 1/042
USPC ..... 37/241, 196, 242; 15/82
See application file for complete search history.

(56) References Cited

U.S. PATENT DOCUMENTS

| | | | | | |
|---|---|---|---|---|---|
| 3,099,852 | A | | 8/1963 | Grant | |
| 3,221,482 | A | * | 12/1965 | Cowling | A01D 34/866 56/15.8 |
| 3,284,831 | A | | 11/1966 | Larsen | |
| 3,457,574 | A | * | 7/1969 | Hirt | E01H 1/005 15/88.4 |
| 3,460,177 | A | | 8/1969 | Rhinehart | |
| 3,475,056 | A | * | 10/1969 | Jones | E01H 4/023 299/24 |
| 3,748,680 | A | | 7/1973 | Griffin | |
| 3,790,981 | A | | 2/1974 | Young | |
| 3,922,745 | A | | 12/1975 | Lehman | |
| 4,084,285 | A | | 4/1978 | Herzog | |
| 4,290,820 | A | | 9/1981 | Swisher et al. | |
| 4,685,228 | A | | 8/1987 | Gisler et al. | |
| 4,835,811 | A | | 6/1989 | Crowhurst | |
| 5,092,012 | A | | 3/1992 | Rabourn et al. | |
| 5,115,531 | A | | 5/1992 | Suzuki | |
| 5,720,069 | A | | 2/1998 | Wanner et al. | |
| 5,951,782 | A | | 9/1999 | Truitt | |
| 6,134,734 | A | | 10/2000 | Marrero et al. | |
| 7,861,347 | B2 | | 1/2011 | McKeown et al. | |
| 9,309,654 | B2 | | 4/2016 | Byrne | |
| 10,349,619 | B2 | | 7/2019 | van der Sluis et al. | |
| 10,701,858 | B2 | * | 7/2020 | Ku | A01D 34/86 |
| 2005/0102778 | A1 | | 5/2005 | Gregerson | |
| 2005/0268940 | A1 | | 12/2005 | Vohra | |
| 2007/0277334 | A1 | * | 12/2007 | McKeown | E01H 5/092 15/88.4 |
| 2009/0070954 | A1 | | 3/2009 | Torno | |
| 2013/0098698 | A1 | | 4/2013 | Johnson et al. | |
| 2015/0033589 | A1 | | 2/2015 | McAdam et al. | |

FOREIGN PATENT DOCUMENTS

| | | | | | |
|---|---|---|---|---|---|
| DE | 19745887 | | | 8/1998 | |
| DE | 29901738 | | | 5/1999 | |
| GB | 2485439 | A | * | 5/2012 | A01B 63/10 |
| JP | H07310310 | A | * | 11/1995 | E01H 1/02 |
| KR | 101106572 | | | 10/2010 | |
| KR | 101411334 | | | 6/2014 | |

* cited by examiner

FIRE HYDRANT SWEEPING MACHINE

CROSS-REFERENCE TO RELATED APPLICATION

This application claims priority from U.S. provisional patent application 62/845,636 filed May 29, 2020, the specification of which is hereby incorporated herein by reference in its entirety.

BACKGROUND

(a) Field

The subject matter disclosed generally relates to snow removal tools or road cleaning tools. More specifically, it relates to a sweeping machine for sweeping an area around an obstacle, such as removing snow or cleaning fire hydrants and utility poles.

(b) Related Prior Art

There are various devices on the market for removing snow or cleaning the streets and sidewalks.

An issue often encountered during such operations is the snow removal or cleaning of particular obstacles, such as fire hydrants or utility poles.

These are requirements regarding the cleaning of particularly fire hydrants, such as the size of the area around the fire hydrant that must be cleaned, the capacity of cleaning the area when other obstacles such as a utility pole are also present in the area, and the fact that the fire hydrant is sometimes located on private property with limited access.

U.S. Pat. No. 7,861,347 B2 relates to a cleaning apparatus to clean small objects. However, it cannot be used very successfully in the context of snow removal, as it has a very small radius of action, and is not adapted to obstacles of a significant height, including the signaling post of the fire hydrant. The same comments are applicable to U.S. Pat. Nos. 9,382,697 B2 or 9,719,222 B2.

There is therefore a need for a sweeping machine that can be used for snow removal and that can address various kinds of obstacles, including fire hydrants and utility poles, for example.

SUMMARY

According to an embodiment, there is provided a sweeping machine for sweeping debris from an area around an obstacle, comprising: a blower; a brush assembly comprising a rotating brush having an axis of rotation which is horizontal and which, in use, directs the debris toward the blower; an arm having a proximal end and a distal end to which the brush assembly is secured; and a pivoting mechanism secured to the blower and to which the arm is mounted, wherein, in use, the pivoting mechanism swivels the arm about a horizontal axis thereby lifting or lowering the brush assembly and swivels the arm about a vertical axis to move the brush assembly within a horizontal plane.

According to an aspect, the arm comprises at least two sub-arms, namely a first sub-arm and a second sub-arm, wherein the second sub-arm is pivotally mounted to the first sub-arm whereby the sub-arms are movable between a plurality of positions.

According to an aspect, the arm comprises a hydraulic linear actuator each connecting the first and the second sub-arms thereby enabling a rotation movement of the second sub-arm about a pivot axis on the first sub-arm.

According to an aspect, the distal end of the arm comprises the second sub-arm and a third sub-arms connected to the brush assembly.

According to an aspect, the arm further comprises another hydraulic linear actuator connecting the first sub-arm to the pivoting mechanism to swivel of the first sub-arm about a horizontal axis thereby lifting or lowering the brush assembly.

According to an aspect, the brush assembly further comprises a frame on which the rotating brush is rotatably mounted and wherein the frame comprises a skirt for deflecting the debris swept from the area toward the blower.

According to an aspect, the brush assembly further comprises a frame on which the rotating brush is rotatably mounted and wherein the frame comprises a skid contacting a ground surface before the rotating brush upon the rotating brush being lowered about the ground surface.

According to an aspect, the rotating brush comprises two opposite ends in a horizontally direction and further wherein the skid is located substantially at an equal distance between the two opposite ends.

According to an aspect, the rotating brush comprises a hydraulic rotary actuator drivable in two directions.

According to an aspect, the rotating brush comprises a brush shaft and bristles, wherein the bristles extend radially from the brush shaft.

According to an aspect, the bristles are made of at least one of rubber, polypropylene and steel wires.

According to an aspect, the bristles are secured around the brush shaft in a number of rows which is between 5 and 10.

According to an aspect, the sweeping machine further comprises a control box mounted to the blower, wherein the control box controls orientation and position of the arm, and power transmitted to the rotating brush.

According to an aspect, the pivoting mechanism comprises a hydraulic linear actuator to enable the swivel of the arm about a vertical axis to move the brush assembly within a horizontal plane.

According to an aspect, in use, the pivoting mechanism further swivels the arm about another horizontal axis to extend or retract the brush assembly.

According to an embodiment, there is provided a sweeping machine to be secured to a blower for sweeping debris from an area around an obstacle, comprising: a brush assembly comprising a rotating brush having an axis of rotation which is horizontal; an arm having a proximal end and a distal end to which the brush assembly is secured; and a pivoting mechanism securable to the blower and to which the arm is mounted, wherein, in use, the pivoting mechanism swivels the arm about a horizontal axis thereby lifting or lowering the brush assembly and swivels the arm about a vertical axis to move the brush assembly within a horizontal plane.

According to an aspect, the arm comprises a plurality of sub-arms pivotally mounted to each other whereby the sub-arms are movable between a plurality of positions relative to each other.

According to an aspect, the distal end of the arm comprises two sub-arms connected to the brush assembly.

According to an aspect, the brush assembly further comprises a frame on which the rotating brush is rotatably mounted and wherein the frame comprises a skid contacting a ground surface upon the rotating brush being lowered about the ground surface.

According to an embodiment, there is provided a sweeping machine to be secured to a blower for sweeping debris from an area around an obstacle, comprising: a brush assembly comprising a rotating brush having an axis of rotation which is horizontal; an arm having a proximal end and a distal end to which the brush assembly is secured; and a pivoting mechanism securable to the blower and to which the arm is mounted, wherein, in use, the pivoting mechanism: swivels the arm about a horizontal axis thereby lifting or lowering the brush assembly; swivels the arm about another horizontal axis to extend or retract the brush assembly; and swivels the arm about a vertical axis to move the brush assembly within a horizontal plane.

Features and advantages of the subject matter hereof will become more apparent in light of the following detailed description of selected embodiments, as illustrated in the accompanying figures. As will be realized, the subject matter disclosed and claimed is capable of modifications in various respects, all without departing from the scope of the claims. Accordingly, the drawings and the description are to be regarded as illustrative in nature and not as restrictive and the full scope of the subject matter is set forth in the claims.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

Referring to the figures and more specifically to FIG. 1, there is described below a sweeping machine 10, e.g., a fire hydrant sweeping machine, which addresses the drawbacks associated to the prior art devices discussed above. The sweeping machine 10 can be used for sweeping an area around an obstacle, such as removing snow or cleaning an area immediately surrounding a fire hydrant, a traffic sign support pole or a utility pole.

Figure 2:
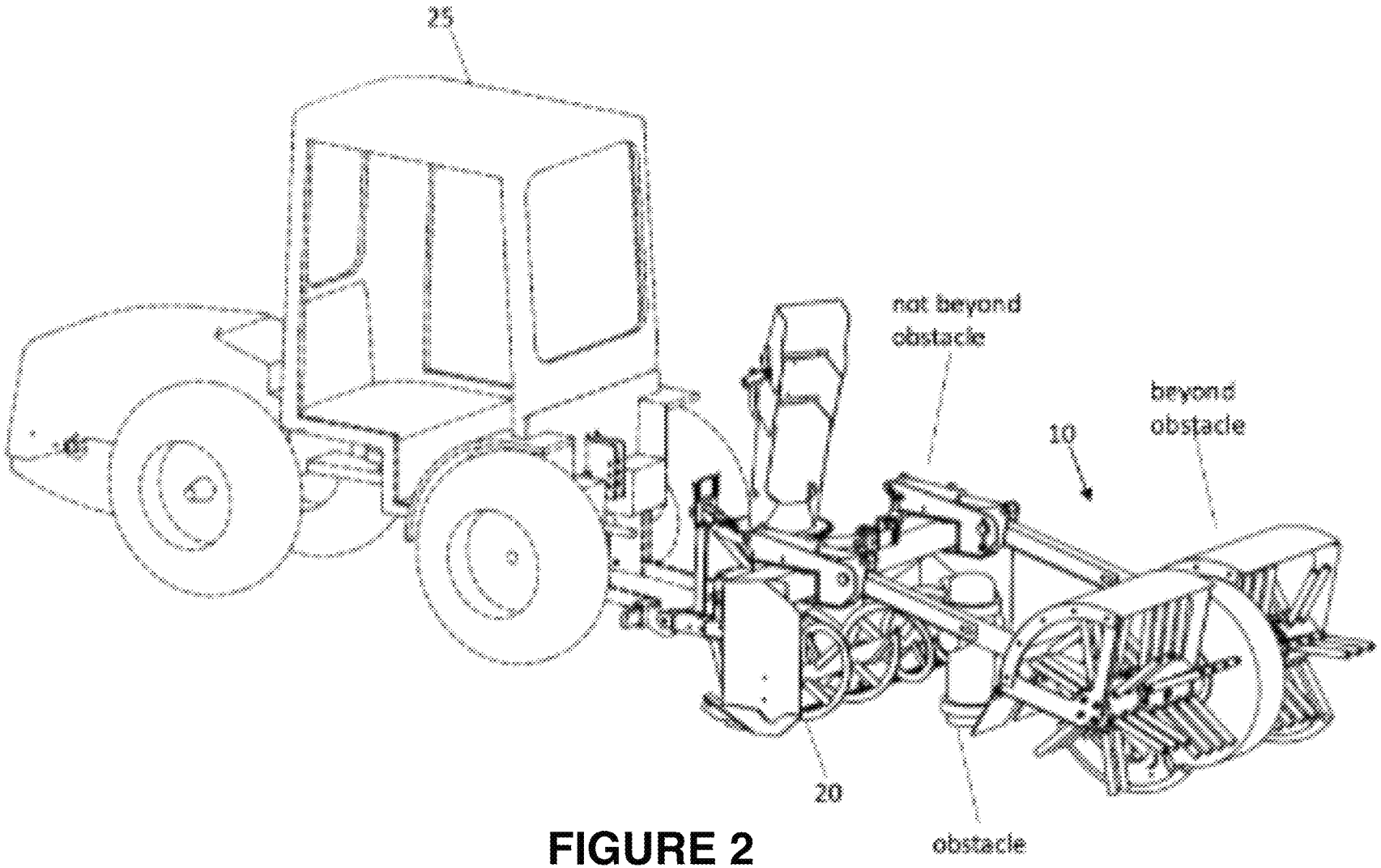
FIG. 2 is a perspective view illustrating a vehicle to which is attached a sweeping machine for sweeping an area around an obstacle, according to an embodiment of the invention.

According to an embodiment, the sweeping machine 10 is provided as a separate and distinct device that can be installed on a vehicle 25, preferably in front of the vehicle 25, as shown in FIG. 2. The vehicle can be a truck or tractor, and preferably includes a blower 20, e.g., a snow blower, in front of which the sweeping machine 10 is provided. The blower 20 can be a standard snow blower of any type known in the art, which comprises a frontward opening for receiving the debris, e.g., snow, a helix such as an endless screw propelled by hydraulics or other mechanical power source and a blower mechanism which throws the snow away. While the drawings show a snow blower and describe the sweeping machine as a snow blower, the type of blower can be replaced by any other suitable device that can receive a substance or debris (such as dust, dirt, small gravel, soil material, etc.) and propel it in a desired direction or store it in a bag. Therefore, the proposed sweeping machine 10 can also be used on a street cleaning vehicle other than a snow blower.

According to another embodiment (not shown), the sweeping machine 10 is integrated to the vehicle 25, or alternatively, integrated to a blower 20 (i.e., not distinct therefrom).

The sweeping machine 10 can be advantageously installed on, and used in cooperation with: a wheel loader, a tracked vehicle, a pick-up truck, any tractor such as a trackless tractor, a holder tractor, a multihog tractor, and the like.

Basically, the sweeping machine 10 should be arranged in a way that surrounds an obstacle by extending forwardly, beyond an obstacle, and sweep the snow of other substance or debris rearwardly, toward the blower 20, which is not beyond the obstacle, as shown in FIG. 2. The area around the obstacle (e.g., fire hydrant) can then be swept by moving the arms rearwardly toward the obstacle (see FIG. 4) and sweeping on either side thereof and/or by swinging the arms our substantially horizontally (from the center toward the exterior and back) (see FIG. 5).

Figure 1:
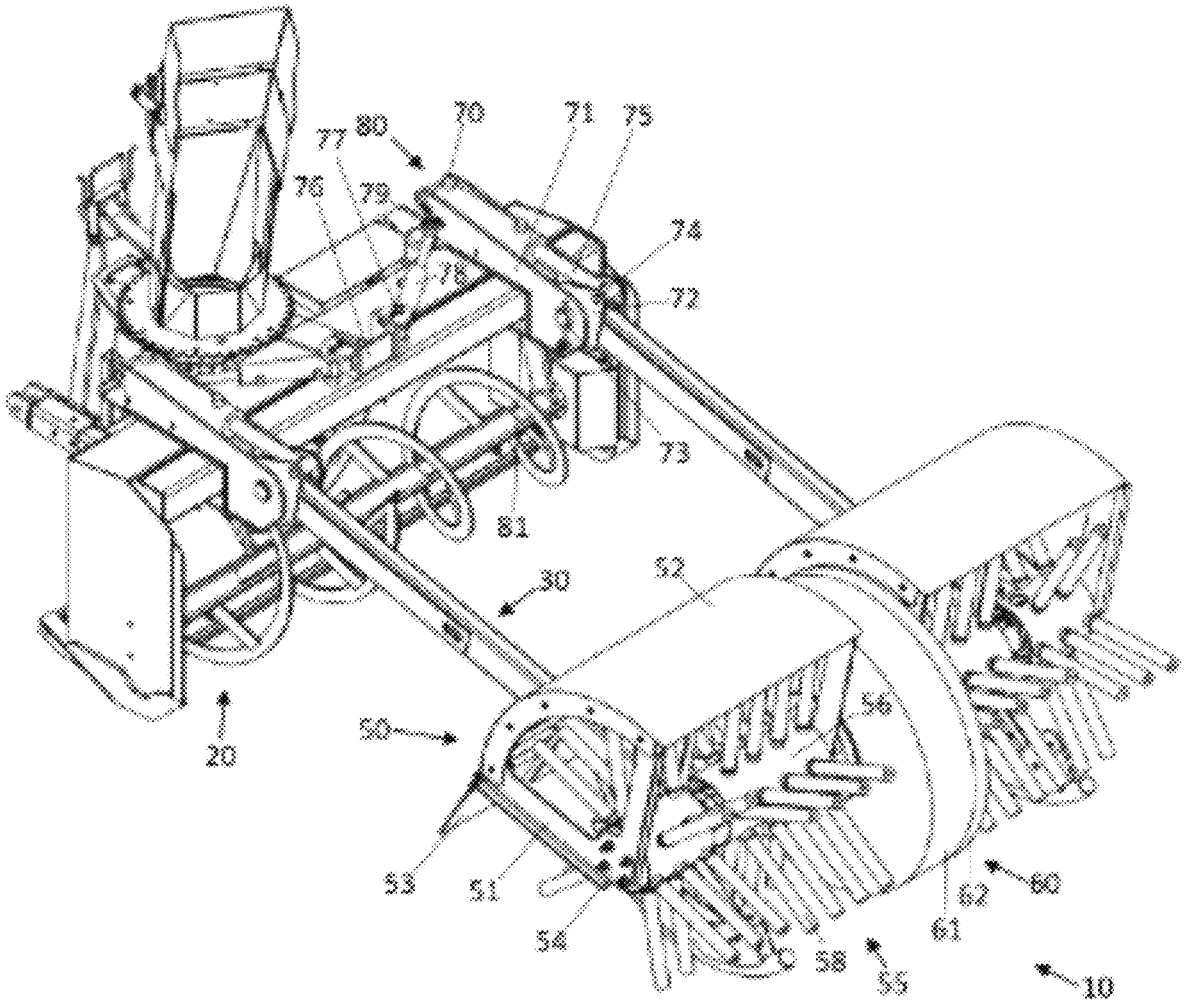
FIG. 1 is a perspective view illustrating a sweeping machine for sweeping an area around an obstacle, according to an embodiment of the invention.
Figure 3:
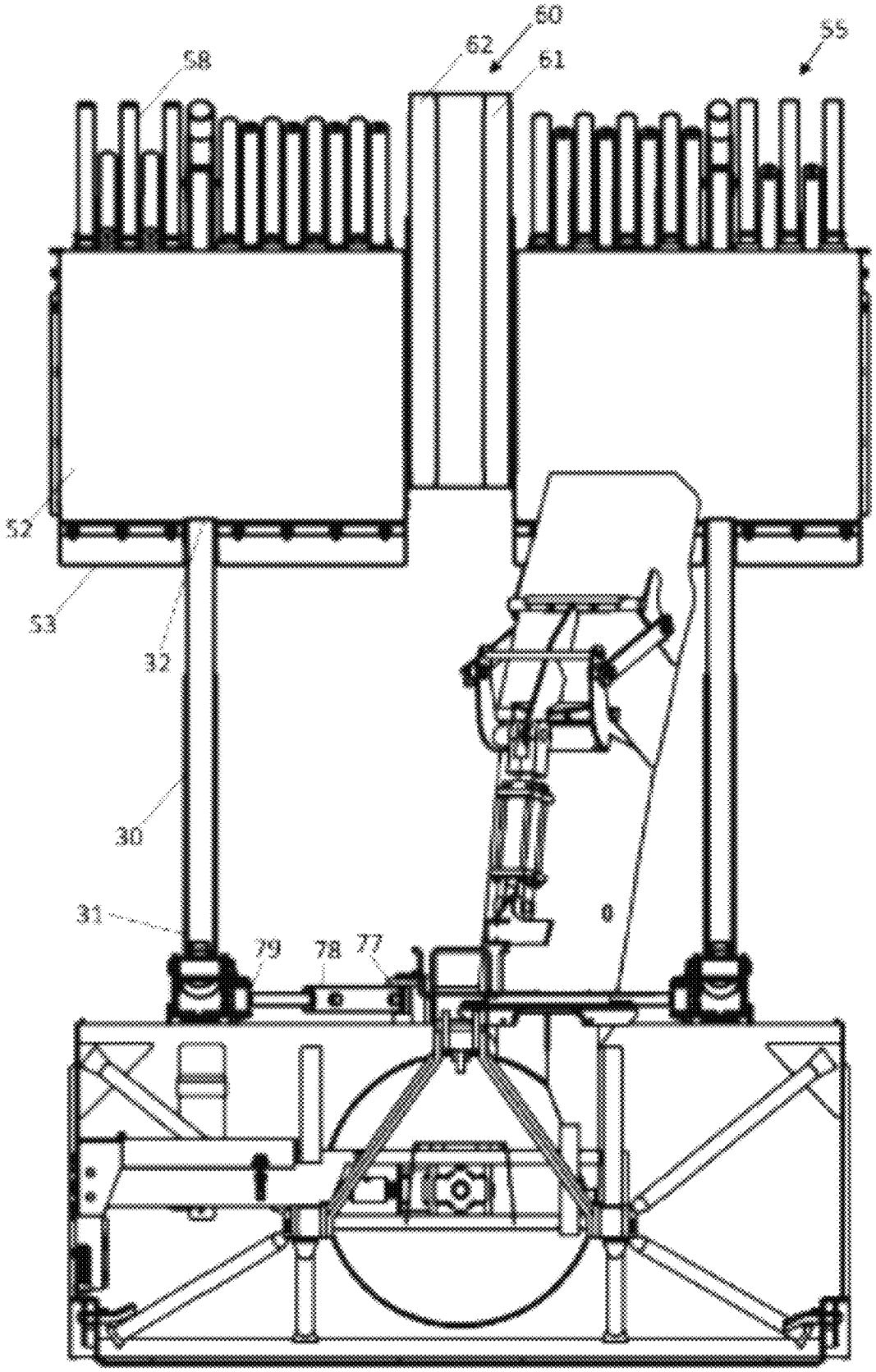
FIG. 3 is a rear view illustrating the sweeping machine for sweeping an area around an obstacle with the arms lifted up, according to an embodiment of the invention.
Figure 4:
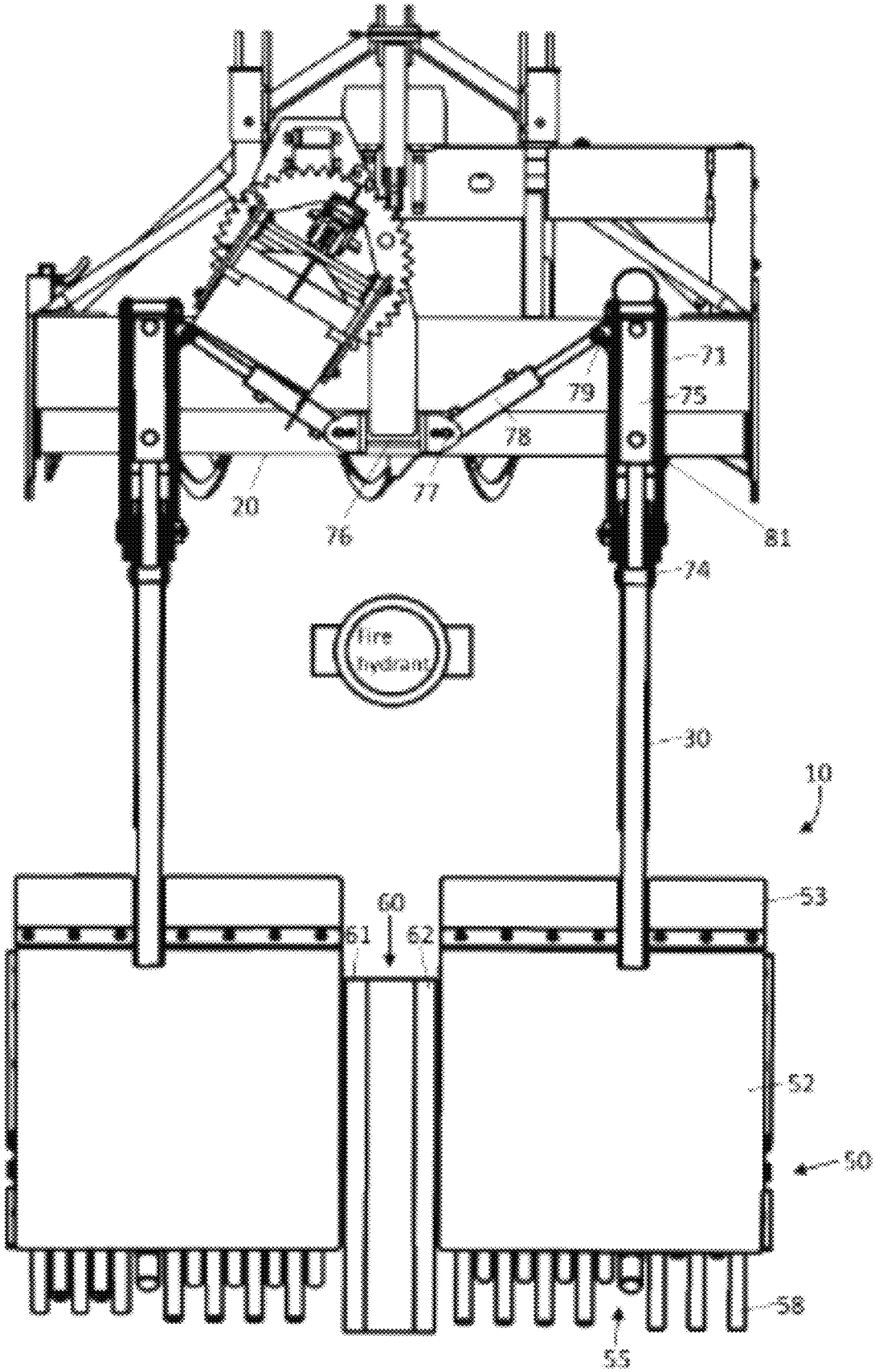
FIG. 4 is a top view illustrating the sweeping machine being used for sweeping an area around an obstacle, according to an embodiment of the invention.

Now referring to the embodiment shown in FIGS. 1 and 3-4, the sweeping machine 10 comprises at least one connecting arm 30 which extends toward a front direction, away from the blower 20, thereby holding the sweeping machine 10 in front of the blower. The at least one connecting arm 30 extends from a proximal connection 31 on an enclosure of the blower 20 to a distal connection 32 on a frame of a corresponding brush assembly 50. Preferably, the at least one connecting arm 30 comprises two arms, each having a corresponding brush assembly 50 at the distal end thereof. Each connecting arm 30 has an axis, which is the direction in which the arm extends, as defined by its proximal and distal ends. If the connecting arm 30 is straight, the axis of the arm is the arm 30 itself.

The brush assembly 50 is the portion of the sweeping machine 10 that performs the actual sweeping around the obstacle. The cleaning is provided by leaving the blower 20 on a proximal side of the obstacle and by providing the brush assembly 50 beyond the obstacle, either by lifting it above the obstacle and then down to the ground, or by widening the arms and bring them back together, as will be described further below. Therefore, to perform sweeping, the brush assembly comprises an actual brush 55.

According to an embodiment, the brush 55 is a rotating brush. According to a more specific embodiment, the rotating brush spins about its own longitudinal axis (shown at the hub representative of the rotation axis 54), which is horizontal, and substantially perpendicular to axis of the connecting arm 30 holding a frame 51 of the brush assembly. Typically, the axis of the connecting arm 30 is the connecting arm itself. Therefore, the axis of the connecting arm 30 and the rotation axis 54 of the brush 55 in the brush assembly 50 held by the at least one connecting arm 30 are perpendicular and together define a plane which is by default perpendicular, but can be controlled in order to be inclined away from the horizontal (for lifting the brush assembly 50), as will be described further below.

According to an embodiment, the brush 55 can be actuated independently from any other brush, or if there are two brushes 55, they can also be actuated together, simultaneously. The power source (hydraulics, mechanical gear or electric power) can be transmitted within each of the connecting arms 30. According to an embodiment, the power is brought into the rotating assembly of the sweeping machine 10 by providing hydraulic power. Appropriate tubing or piping can extend along the connecting arms to bring pressurized fluid to the rotating assembly and provide power.

Figure 6:
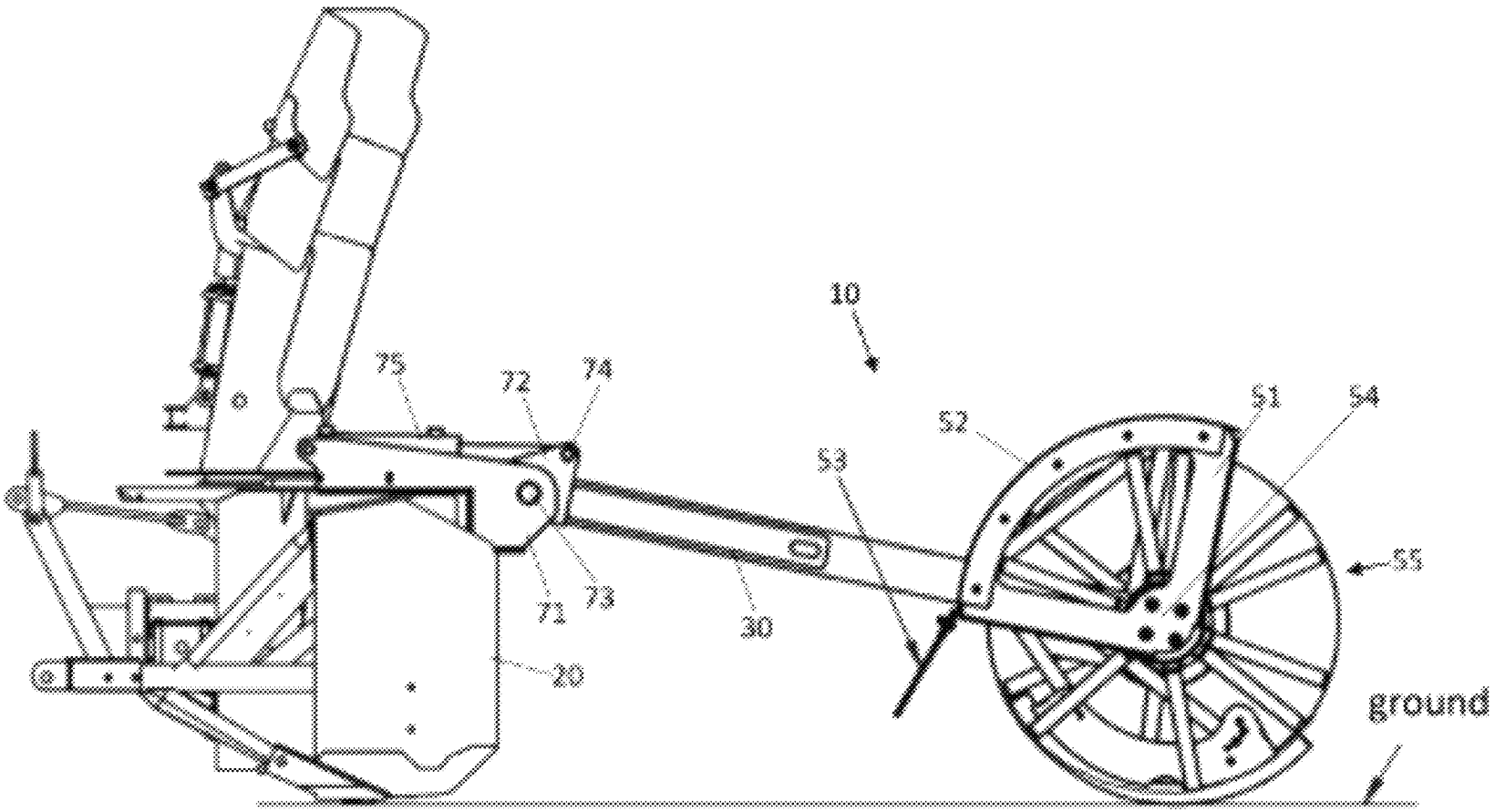
FIG. 6 is a side view illustrating the sweeping machine being used for sweeping an area around an obstacle, according to an embodiment of the invention.

The brush 55 can then rotate around the rotation axis 54, and if the brush 55 lays on the ground, as shown for example in FIG. 6, the bristles 58 can sweep the floor/ground. The rotation of the brush 55 should be actuated in the direction that ensures the bristles 58 sweep the ground contents rearwardly, toward the blower 20.

In order to perform a clean sweeping, the brush assembly 50 can comprises, in addition to the brush 55, a cover 52 that prevents the snow or other debris to be swept in the air and obstruct the vehicle's driver field of view or send the snow and debris everywhere. To further keep the snow or debris being swept close to the ground right after it is swept, a skirt 53 can be provided as shown in FIG. 1 or FIG. 6. The skirt 53 is provided at the lower edge of the cover 52, and is inclined rearwardly to ensure that the snow or debris that is being swept is actually swept but kept toward the ground. This ensures a clean sweeping process and directs the snow or debris toward the snow blower 20.

The cover 52 and the skirt 53 are held in place by being secured to a frame 51 which holds the brush 55 at the rotation axis 54 thereof and which is also secured to a distal end of the connecting arm of this brush assembly 50.

According to an embodiment, the bristles 58 of the brushes are made of at least one of the following materials: rubber, polypropylene, or steel wire (as used in street cleaning vehicles). The bristles 58 should be rather rigid as they should be able to crush hardened snow back into a powder or break or snow crusts.

Figure 5:
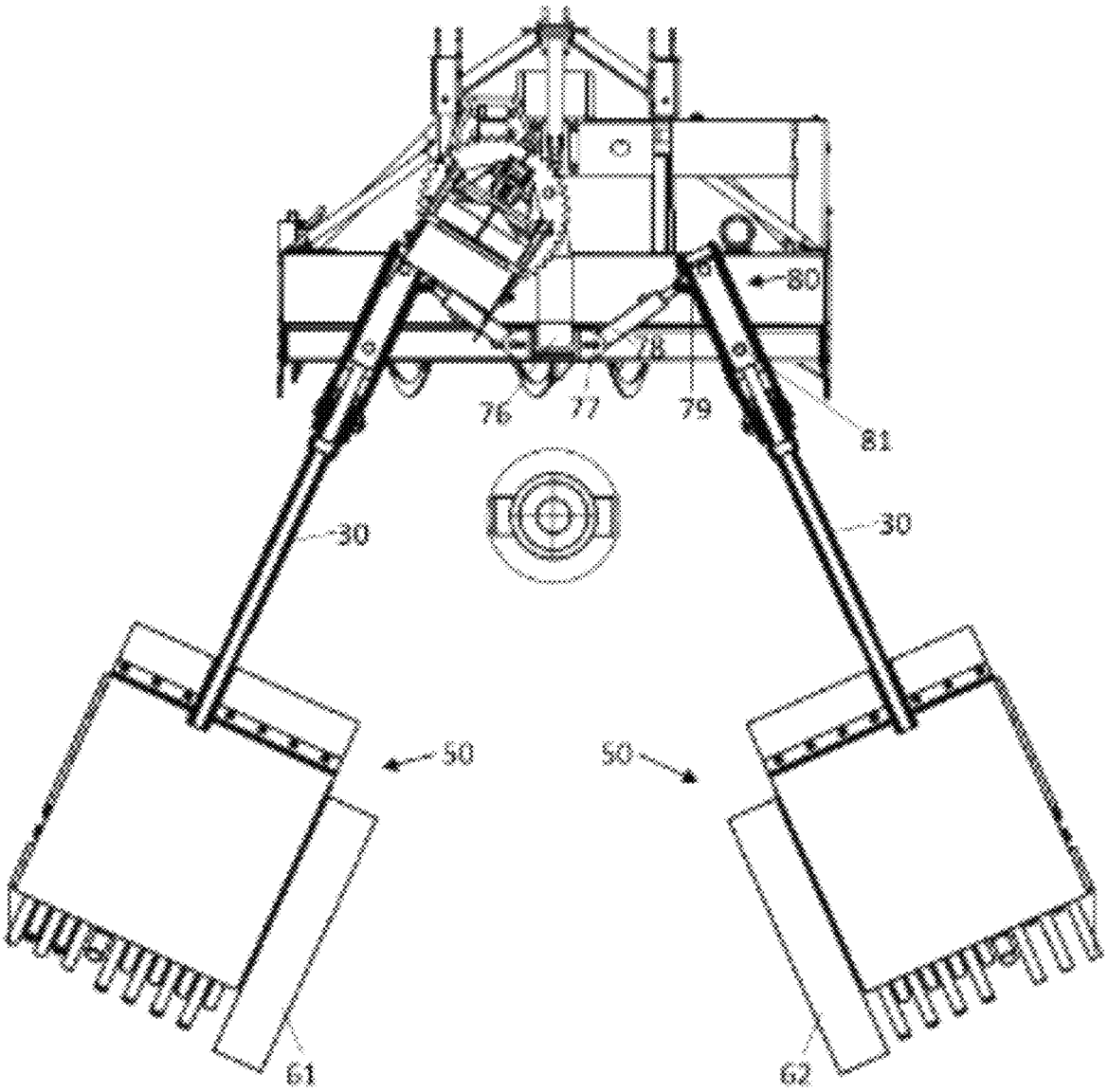
FIG. 5 is another top view illustrating the sweeping machine being used with arms that are widened for moving around an area around an obstacle, according to an embodiment of the invention.
Figure 7:
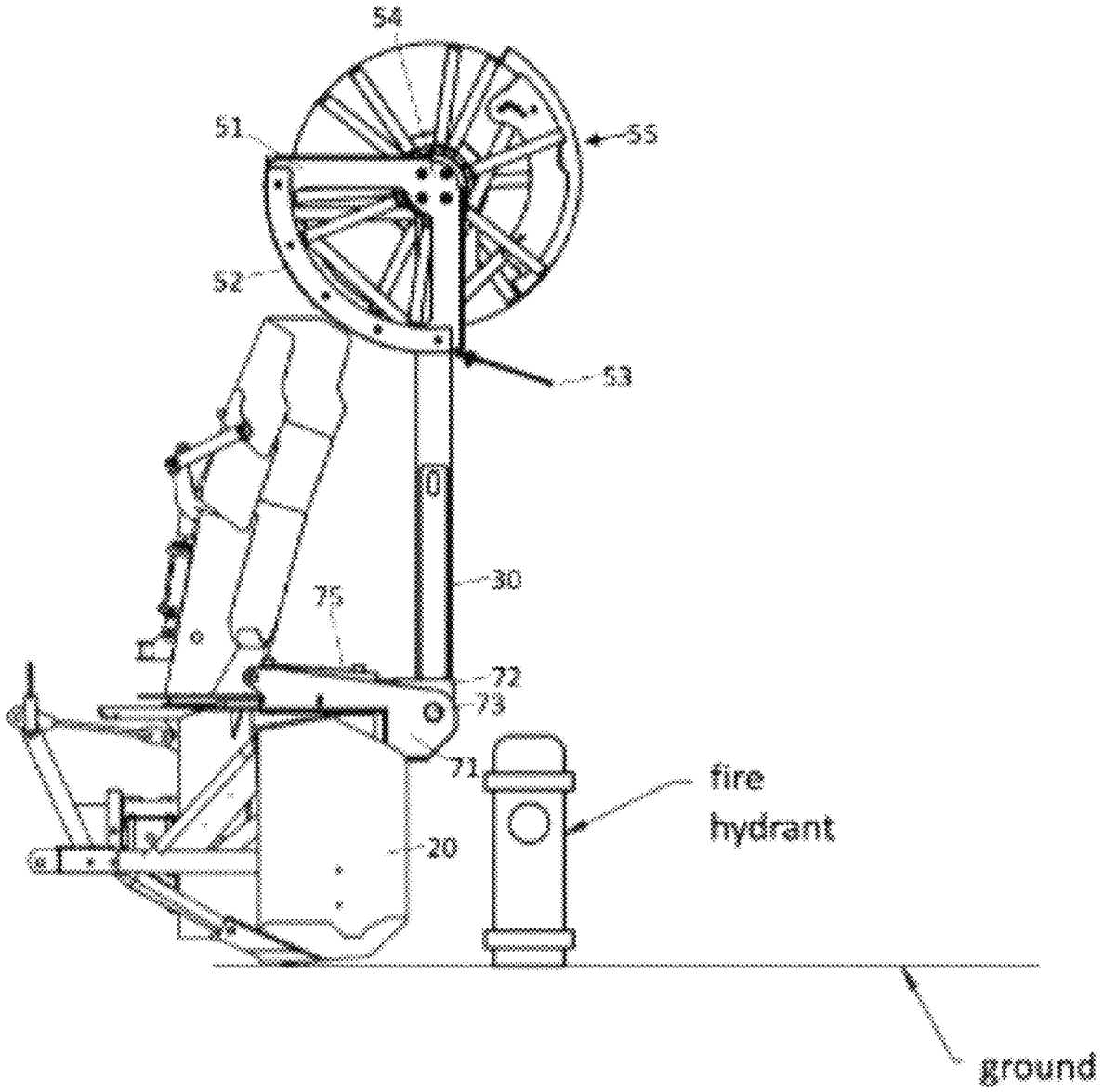
FIG. 7 is another side view illustrating the sweeping machine being lifted up for moving in an area around an obstacle, according to an embodiment of the invention.

There is now described a pivoting mechanism 80, the effects of which are illustrated by comparing FIGS. 4-5 (arm widening) or FIGS. 6-7 (lifting).

Arm widening is shown in FIG. 5 and can be used to avoid and surround an obstacle, in particular an elongated obstacle such as a utility pole. After having moved the brush assemblies 50 beyond the obstacle with the arms widened (FIG. 5), they can be brought back together (FIG. 4) to perform actual sweeping. Alternatively, the brushes 55 can be used while the arms are widened (FIG. 5) to sweep a large area on the ground, beyond and around the obstacle, while the vehicle 25 is immobilized.

According to an embodiment, and as shown in FIG. 7, the sweeping machine 10 can be lifted up by providing a hinge 73 at the proximal connection of the at least one connecting arm 30. This is useful to reduce the overall length of the vehicle 25, for example when the vehicle 25 is in transit on the road. This is further useful in that the weight of the sweeping machine 10 is brought closer to the vehicle 25, thus reducing its moment of force and making the vehicle 25 more stable. Otherwise, lifting the sweeping machine 10 can be useful to use the blower 20 in a traditional fashion without requiring the sweeping machine 10, thus keeping it out of the way.

As shown in FIG. 7, the sweeping machine 10 can be pivoted upwardly along an arc of circle such that the sweeping machine is brought away from the ground; then the vehicle 25 can move closer to an obstacle such as a fire hydrant and let the sweeping machine 10 pivot back down onto the ground such that the at least one connecting arm 30 and corresponding brush assembly 50 enclose the obstacle, i.e., the obstacle is located between the brush assembly 50 and the blower 20.

The pivoting mechanism 80 is used to perform the upward swivel of the connecting arms 30 and/or the widening of the connecting arms 30, each of these movements being performable independently (i.e., can be simultaneous or not since each one has its own actuators).

The actuation of the lifting is performed using a cylinder 75, aka linear actuator, shown in FIGS. 1 and 3-7. The cylinder 75 is housed in a base 71 which is attached to the blower 20 (or an equivalent thereof), for example secured to the top surface of the blower 20. The cylinder 75 is fixed to a proximal end 70 of the base 71, and can push or pull on a distal end pin 74. The distal end pin 74 is a pin which is engaged and free to rotate within a swivelable socket 72. The swivelable socket 72 receives the proximal end of the connecting arm 30, to which it is fixedly secured, and is free to swivel about the swivel pin or hinge 73 formed in the base 71.

Therefore, actuating the cylinder 75 to retract it causes the cylinder 75 to pull the distal end pin 74 toward a proximal direction, more or less horizontally (formally, along an arc of circle), which makes the swivelable socket 72 swivel around its hinge 73 in the base 71, thus pivoting the swivelable socket 72 and, along it, the connecting arm 30 and the whole brush assembly 50 secured to that arm. The brush assembly 50 is therefore pivoted upwardly and increasingly toward a proximal direction, along an arc of circle, and is therefore lifted.

Conversely, when the cylinder 75 is actuated in extension, it pushes onto the distal end pin 74, thus making the swivelable socket 72 swivel about its hinge 73 and brining the connecting arm 30 and the whole brush assembly 50 secured to that arm downwardly toward the ground in a reversible movement.

Now in reference with the widening movement, there is provided a fixation 76 which is secured to the snow blower 20. The actuator for this movement is the cylinder 78, which extends from it pivot point 77 on the fixation 76 to the pivot point 79 on the base 71, close to the proximal end 70 thereof. To allow this widening movement, the base 71 should not be firmly fixed to the blower 20, but should be allowed to rotate within the horizontal plane by securing the base 71 to the blower 20 using a screw or pin arrangement which provides a pivot point 81 of the base with respect to the top enclosure of the blower 20. The pivot point 81 is indicated approximately in FIG. 1 and FIGS. 4-5, although the pin or screw around which the base 71 can rotate is not visible.

By allowing a horizontal pivoting movement around the pivot point 81, the cylinder 78 can pull the proximal end 70 of the base 71, as shown by comparing FIG. 4 with FIG. 5, which produces the horizontal pivoting movement of the base 71. Since the base 71 holds in place the socket 72 which houses the proximal portion of the connecting arm 30, the horizontal pivoting movement of the base 71 causes the horizontal pivoting movement of the connecting arm 30 accordingly, with respect to the pivot point 81. The brush assembly 50 is also brought into this movement, hence the widening of the arms shown in FIG. 5. This movement is reversible by having the cylinder 78 retract.

When the widening movement is reversed, if there are two brush assemblies 50, they are being brought together one against the other. Cushions 61, 62 can be provided on the neighboring sides of each of them to form a cushion assembly 60 in-between.

The cylinders 75 and 78 can also be replaced by other actuators, and can be hydraulic cylinders or other types of actuator such as electric linear motors.

It should be understood that the actuators were described with respect to a single base 71/connecting arm 30/brush assembly 50, although each of these should be replicated symmetrically with respect to the fixation 76 to ensure that the pair of arms 30 and the corresponding brush assembly 50 can perform the same movement together, preferably simultaneously.

It should be understood that the at least one connecting arm 30 should preferably comprise a pair of arms working together, as shown in the figures. However, the system may also be used with only one connecting arm and corresponding brush assembly 50, as long as the vehicle 25 remains balanced during the movement thereof.

According to an embodiment, the at least one connecting arm 30 can be telescopic in order to have its length vary longitudinally, thereby changing the relative distance between the brush assembly 50 and the snow blower 20. If there is more than one arm, every one of the at least one connecting arm 30, e.g., both of the two arms, should be telescopic in a similar manner.

Now referring to FIGS. 8 to 24, there is described another embodiment of a sweeping machine 110 operating as a fire hydrant sweeping machine that addresses the drawbacks associated with the prior art discussed above. The sweeping machine 110 is designed for sweeping debris from an area around an obstacle, and more specifically the area around a fire hydrant, from snow, and to direct the removed snow to a blower 20 adapted to efficiently blow the debris away from the obstacle. The sweeping machine 110 is further adapted to clean an area dimensioned to respect the requirements associated thereto.

Figure 8:
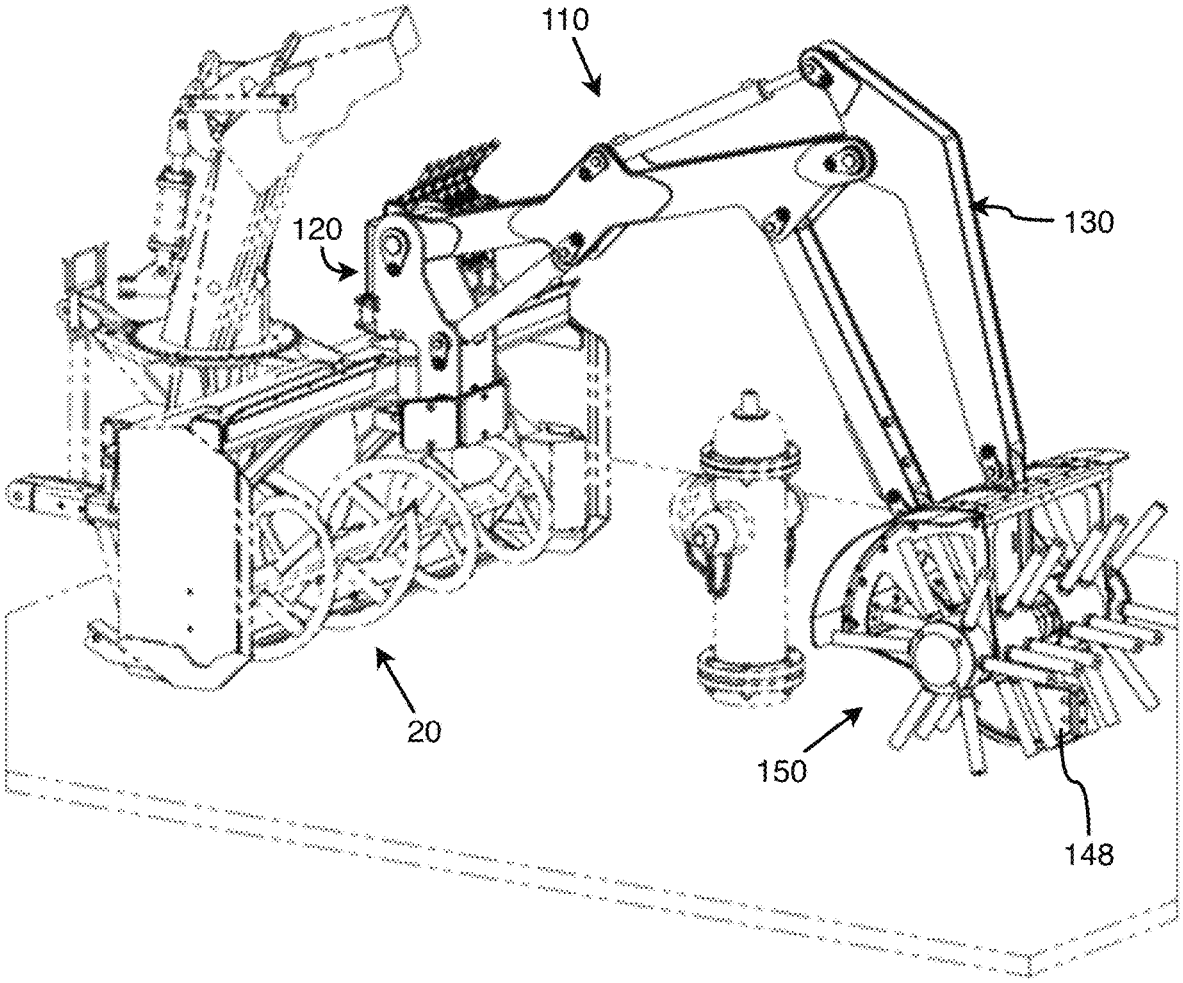
FIGS. 8 and 9 are perspective views from the front left side and right side of another embodiment of a sweeping machine.
Figure 9:
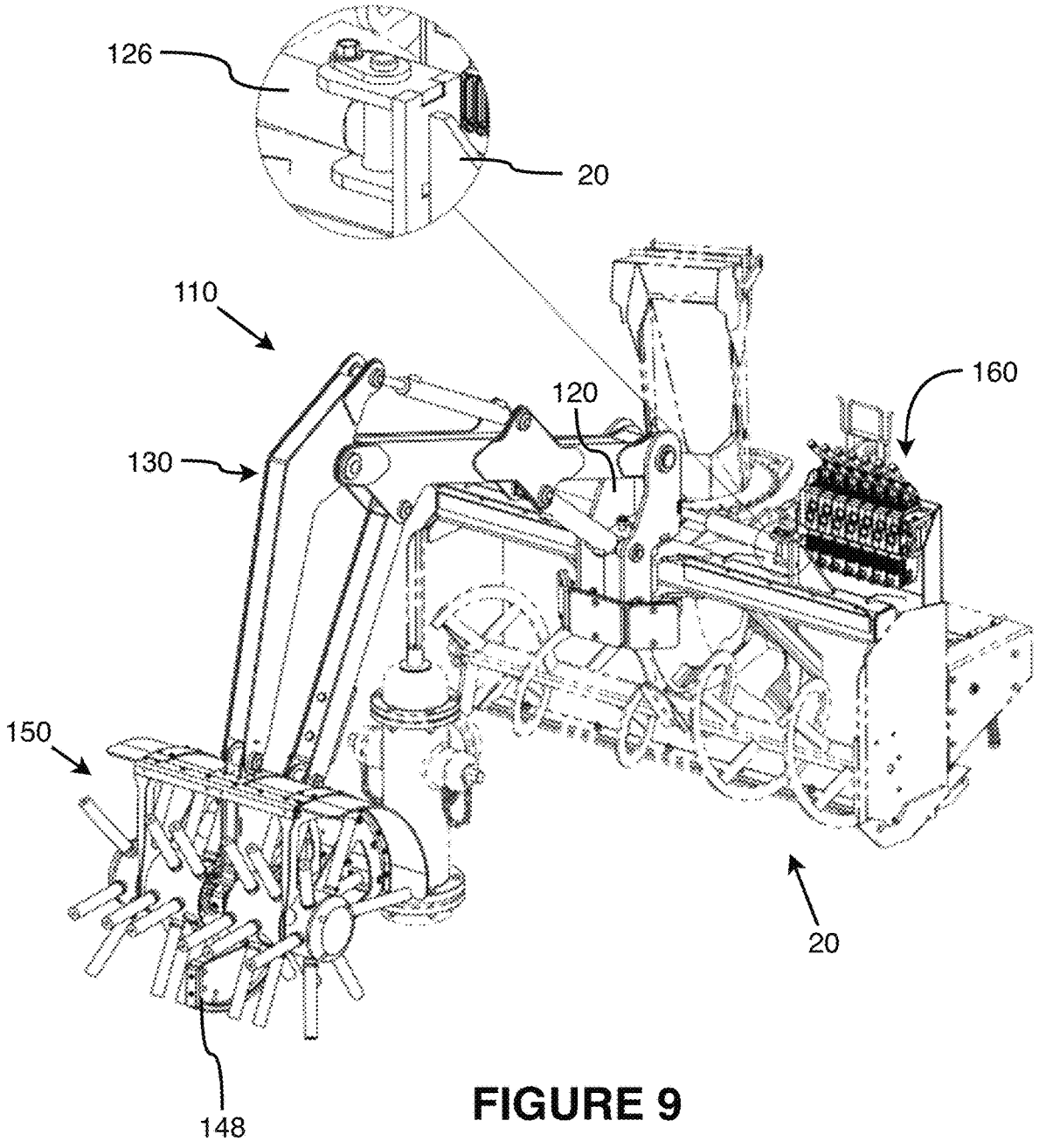
Figure 10:
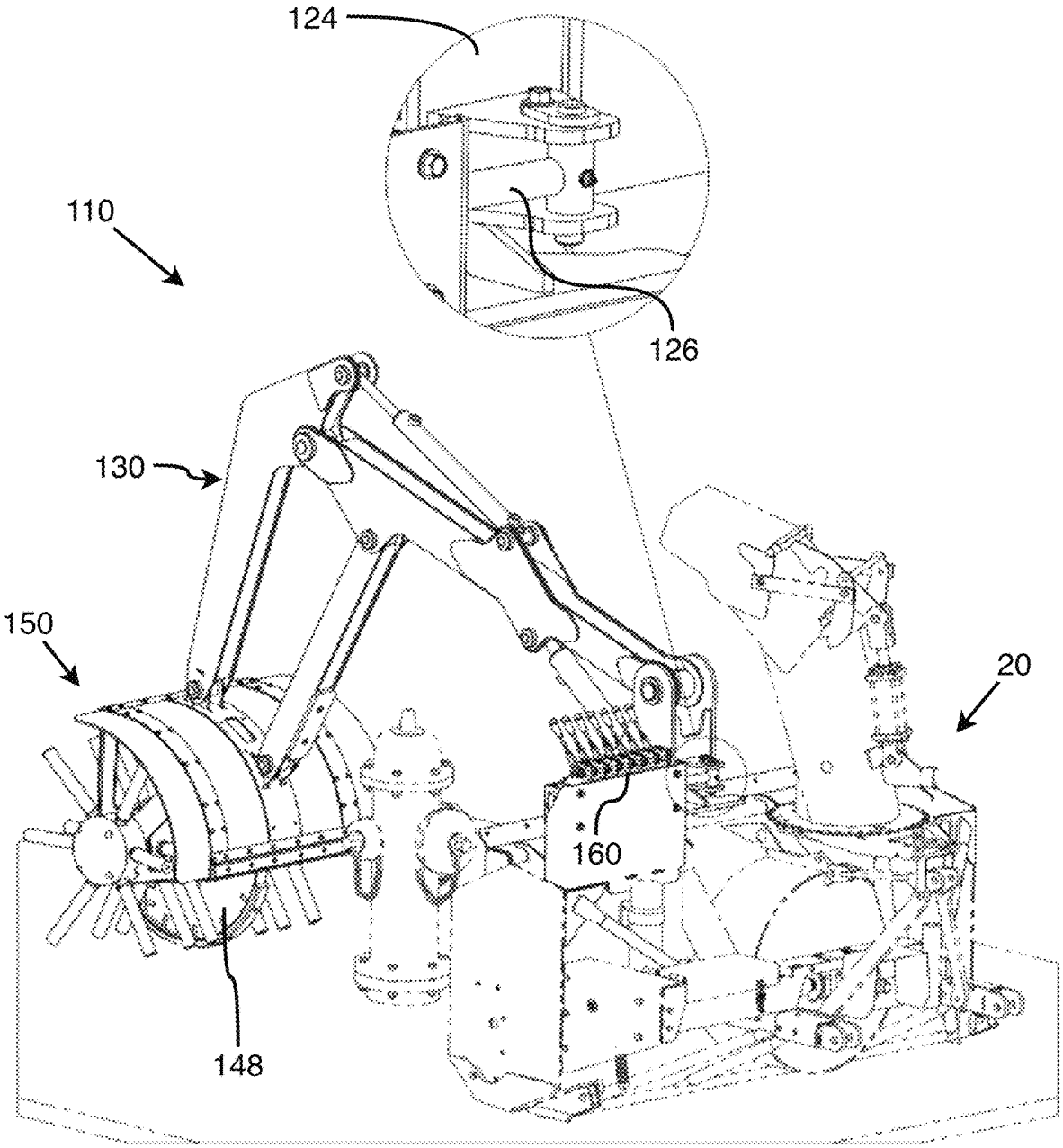
FIG. 10 is a perspective view of the sweeping machine of FIGS. 8 and 9 from the back.

Referring now particularly to FIGS. 8 to 10, the sweeping machine 110 is adapted to be mounted to a blower 20, e.g., a snowblower, itself part of a vehicle (similar to vehicle 25) or alternatively releasably mounted to a vehicle. Accordingly, the sweeping machine 110 and the blower 20 take the same geometrical references as the vehicle, comprising a longitudinal orientation, a front, a rear, sides, a top and a bottom where about the ground.

Figure 15:
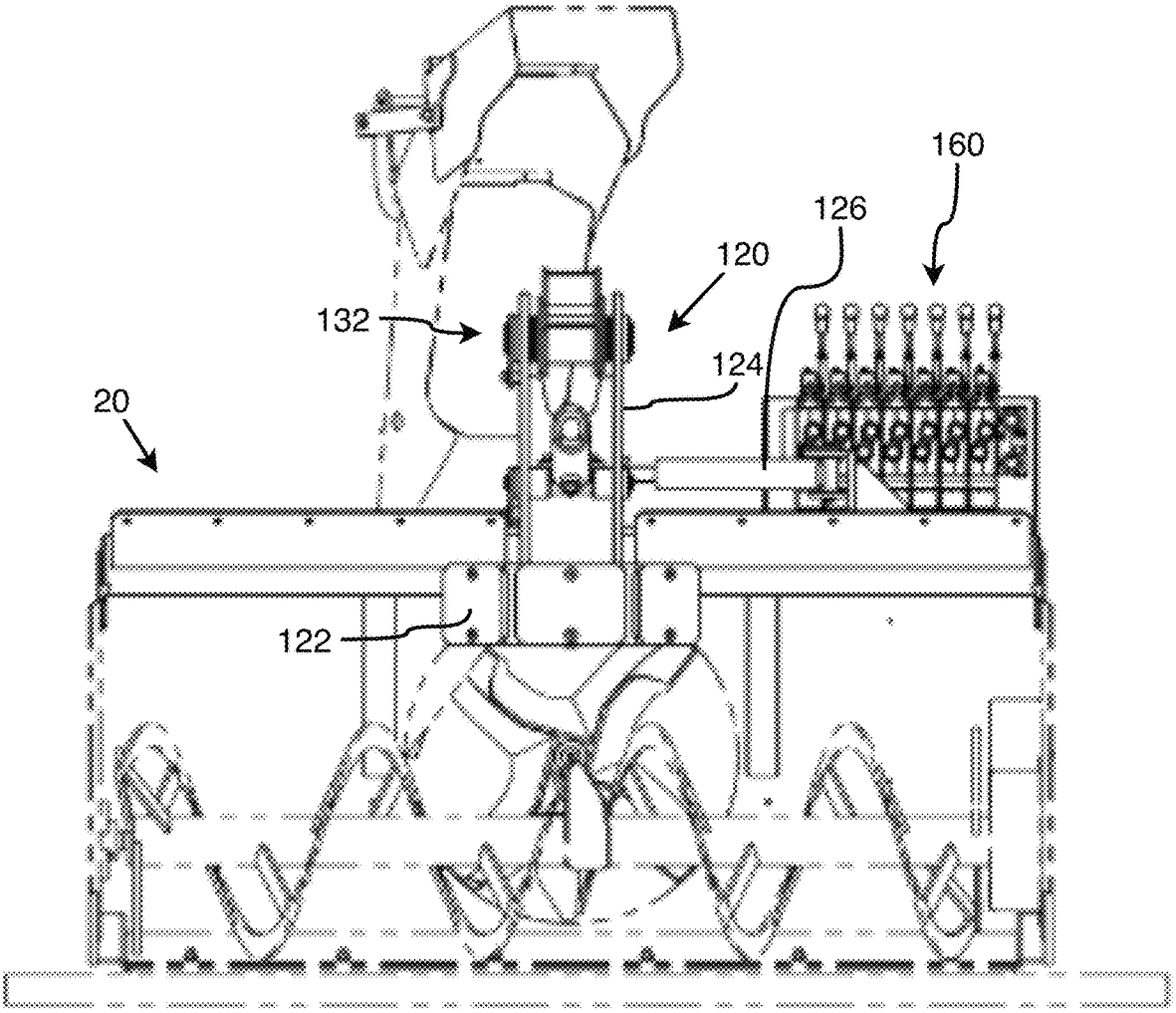
Figure 16:
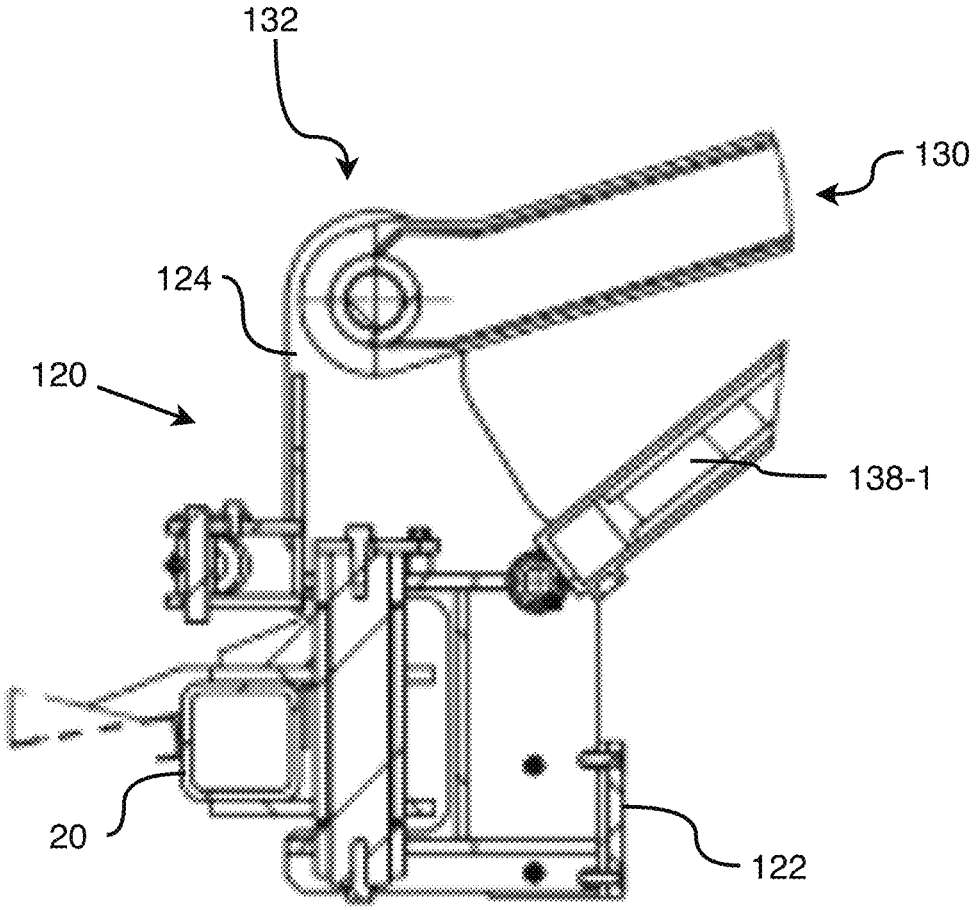
FIG. 16 is a cross-section view of the sweeping machine according to the view plan identified on FIG. 11.
Figure 17:
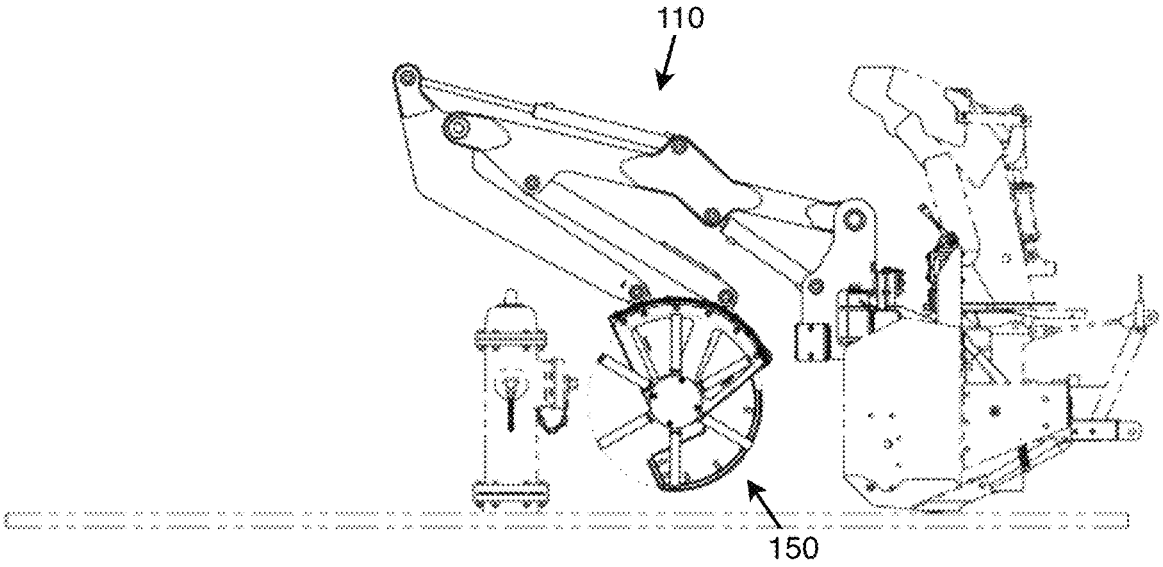
FIGS. 17 to 22 are side views of the sweeping machine of FIGS. 8 to 10 in different positions during a fire hydrant cleaning operation.
Figure 18:
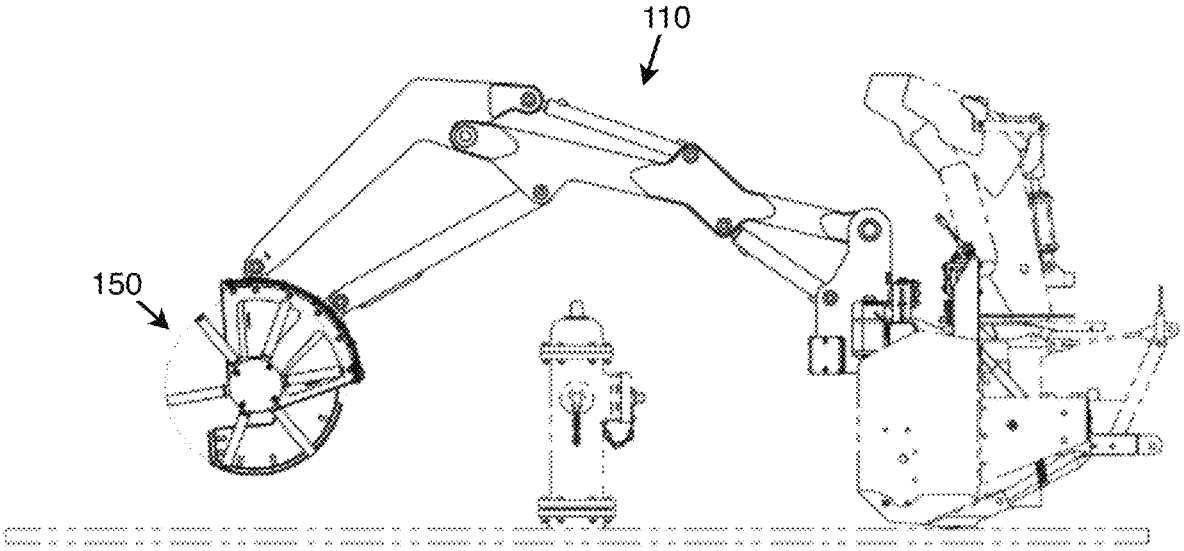

Referring additionally to FIGS. 15 and 16, the sweeping machine 110 comprises a mount component 120 to be mounted to the front of the blower 20. The mount component 120 is adapted to be mounted to the top front edge of the blower 20, with a shield 122 covering protecting the mobile components of the sweeping machine 110 extending about the mouth of the blower 20.

The mount component 120 is further adapted to swivel about a vertical axis 151 (see FIG. 24), allowing to orientate the brush assembly 150 of the sweeping machine 110 within a range of operating orientations.

In order to swivel, the mount component 120 comprises a hydraulic actuator 126 linking the pivotal structure 124 to a fixed point, namely the structure of the blower 20. Therefore, upon application of power to the hydraulic actuator 126, the operator can control the angle of the pivotal structure 124 and thus the orientation of the brush assembly 150.

Figure 11:
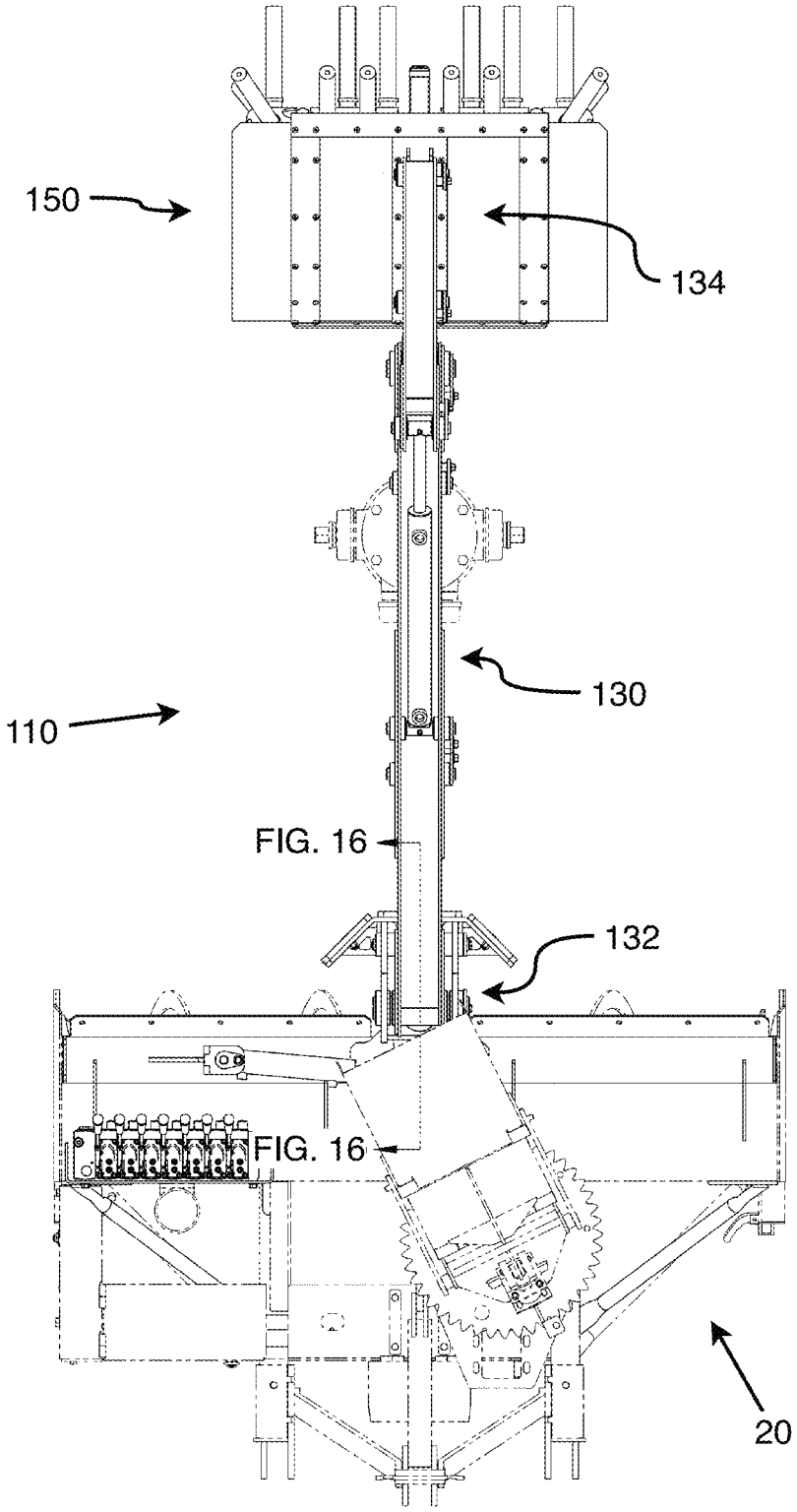
FIG. 11 is a top view of the sweeping machine of FIGS. 8 to 10.
Figure 12:
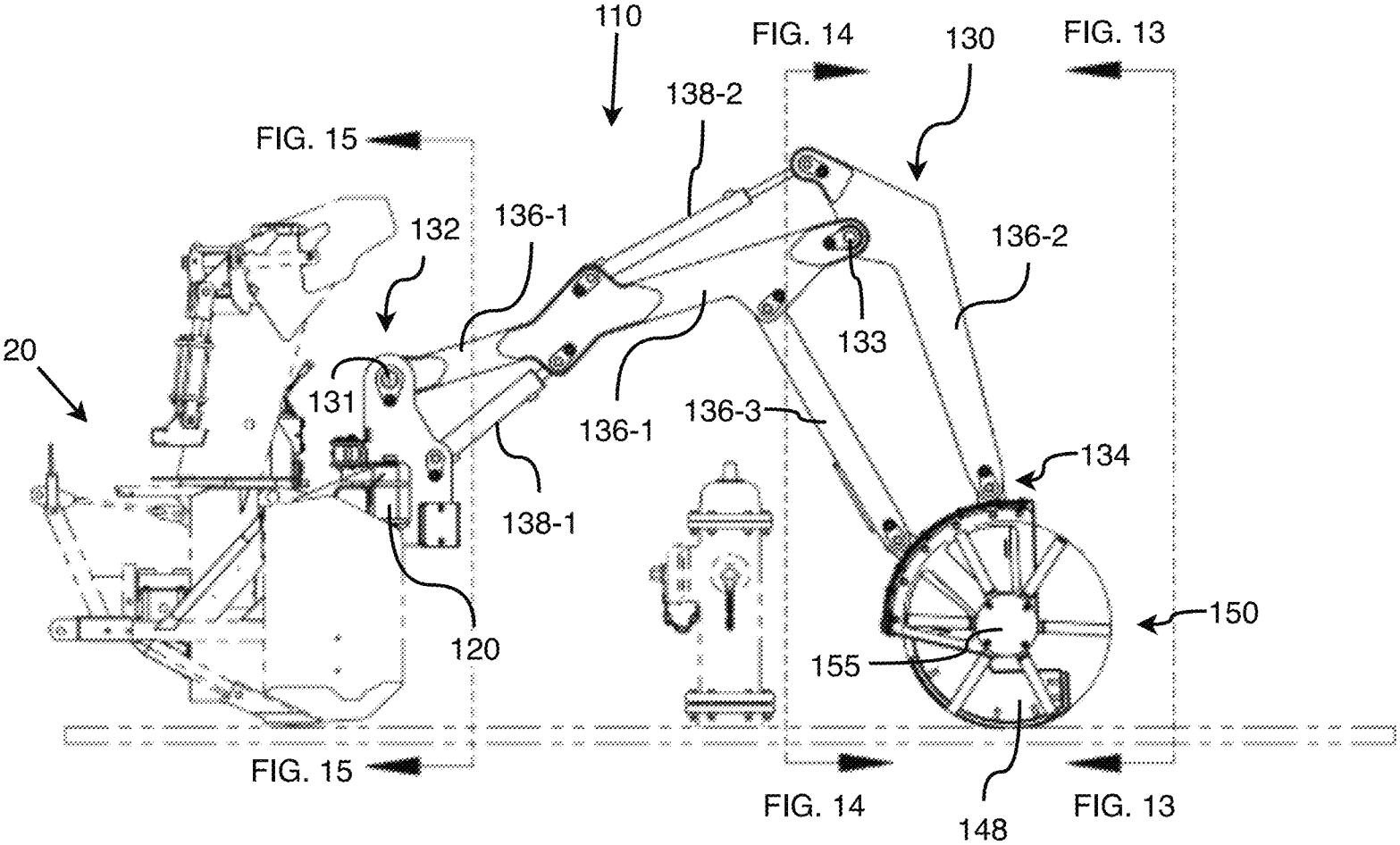
FIG. 12 is a side view of the sweeping machine of FIGS. 8 to 10.

Referring to FIGS. 11 and 12, the sweeping machine 110 comprises an arm 130 with the mount end 132, aka proximal end 132, of the arm 130 pivotally mounted about a horizontal pivot 131 (i.e., horizontal axis) to the pivotal structure 124. The arm 130 extends from the mount component 120 frontward to a distal end 134, aka brush end 134.

The arm 130 comprises a series of sub-arms 136 pivotally mounted to each other and able to take a plurality of positions according to the angle between each of the sub-arms 136. A series of hydraulic linear actuators 138 further link sub-arms 136; the hydraulic linear actuators 138 allowing to control the angle between two linked sub-arms 136.

The arm 130 further comprises a brush end 134 with three sub-arms 136-1, 136-2 and 136-3. The brush end 134 thereby is pivotally connected to the brush assembly 150 at two locations distant from each other, with the modification of the angle between the sub-arm 136-1 and the sub-arm 136-2 (about another horizontal pivot 133, aka another horizontal axis) by the corresponding hydraulic actuator 138-2 while the sub-arm 136-3 following the displacement of the sub-arm 136-2 resulting in a change in the angle of the brush assembly 150.

The raising and lowering the entire arm 130 are performed by extending or retracting hydraulic linear actuator 138-1.

Figure 13:
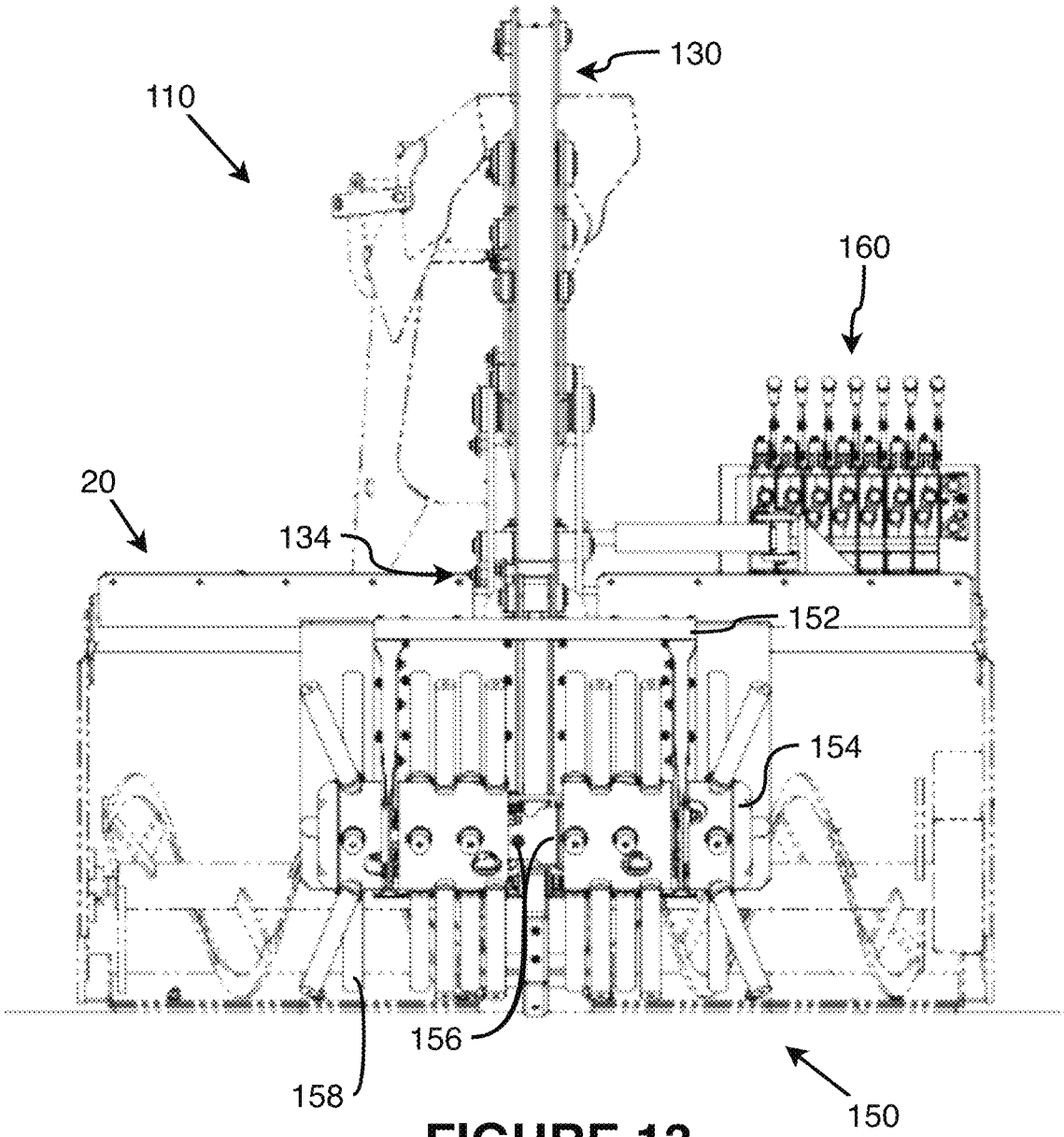
FIGS. 13 to 15 are cross-section views of the sweeping machine of FIGS. 8 to 10 according to the view planes identified on FIG. 12.
Figure 14:
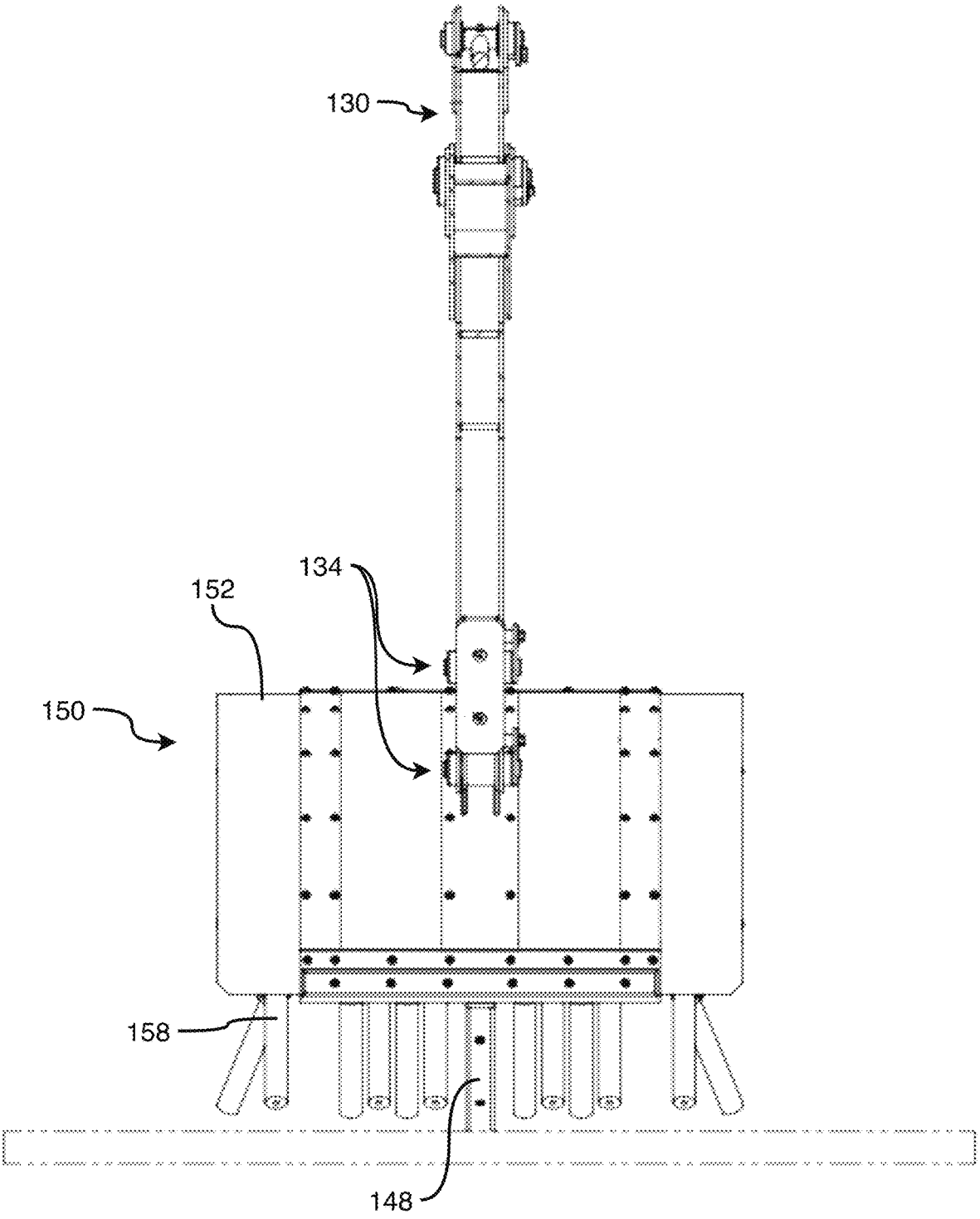

Referring additionally to FIGS. 13 and 14, the sweeping machine 110 comprises a brush assembly 150 dually and pivotally mounted to the brush end 134 of the arm 130. The brush assembly 150 comprises a frame 152 and a rotating brush 154 mounted to the frame. More particularly, the rotating brush 154 comprises a horizontal brush shaft 156 with bristles 158 extending radially from the brush shaft 156 able to sweep debris, e.g., snow, off the ground surface rearward or frontward depending on the direction of rotation of the brush shaft 156.

According to an embodiment, the axis of rotation of the rotating brush 154 is limited to the brush horizontal axis 155; that is, according to such an embodiment, the rotating brush 154 must rotate only according to a brush horizontal axis 155. This greatly simplifies the design of the sweeping machine 110 and saves on costs.

The frame 152 has a cylindrical shape extending over about between 90 degrees that provides clearance in-between for the debris swept rearward by the bristles 158 to reach the blower 20 wherein the debris are blown away from the area around the obstacle, namely moved and redirected to a location appropriate where the debris will not hinder access to the obstacle, e.g., fire hydrant.

The brush assembly 150 is further mounted to the brush end 134 of the arm 130 about the center according to a transverse orientation with the brush assembly 150 extending on both sides of the connection. This configuration enables a portion of the bristles to clean an area beyond an obstacle with the arm 130 being located either at the left or the right of the obstacle, thus without touching the obstacle.

To perform a clean sweeping, the brush assembly 150 can, as illustrated in relation with the embodiment of the sweeping machine 10, comprises a cover 52/152 that prevents the snow or other debris to be swept in the air and obstruct the vehicle's driver field of view or send the debris everywhere. To further keep the debris being swept close to the ground right after it is swept, the sweeping machine 10/110 may comprise a skirt 53 (see FIG. 6). This ensures a clean sweeping process and directs the debris toward the blower 20.

The cover 52/152 and the skirt 53 are held in place by being secured to a frame 152 which holds the brush shaft 156 to deflect debris downward, thus toward the blower 20 instead of toward the vehicle 25.

According to an embodiment, the bristles 158 are made of at least one of the following materials: rubber, polypropylene, or steel wires (as used in street cleaning vehicles). The bristles 158 should be rather rigid as they should be able to crush hardened snow back into a powder or at least break the snow into small crusts.

According to an embodiment, between 5 and 10 arrays (rows) of bristles 158, thus with between about thirty-six (36) and seventy-two (72) degrees between two adjacent arrays of bristles, extend from the brush shaft 156. According to another embodiment (not depicted), the arrays of bristles 158 are not straight, but rather of a spiral shape that extend over the brush shaft 156.

The sweeping machine 110 further comprises a skid 148 extending downward from the frame 152 beyond the bristles, whereby when lowering the brush assembly 150 the skid 148 first touches the ground and thereby preventing the bristles 158 to attack the ground. Preferably, the skid 148 extends about the center of the brush assembly 150, with portions of the brush shaft 156 extending sideways in opposite directions.

According to an embodiment, the sweeping machine 110 is powered by the hydraulic system (not depicted) of the vehicle 25. Thus, hydraulic actuators 126 and 138 are connected to the hydraulic system.

According to a preferred embodiment, the hydraulic actuators 126 and 138 are hydraulic linear actuators.

According to an embodiment, the brush shaft 156 comprises a hydraulic rotary actuator (not depicted) that is also powered by the hydraulic system of the vehicle.

According to an embodiment, the hydraulic rotary actuator can controllably rotate in both directions. Therefore, according to conditions, for example when the brush assembly 150 is located beyond the obstacle, e.g., a fire hydrant, the debris, e.g., snow, may be swept frontward to avoid sweeping the debris on the fire hydrant. In other conditions, for example with a high snowbank beyond the obstacle or when the brush assembly 150 is operating between the blower 20 and the obstacle, the brush assembly 150 may rotate such as to push the debris toward the blower 20 for the debris to be blown by the blower 20 away from the area around the obstacle.

Referring to FIGS. 8 to 10, according to an embodiment, the sweeping machine 110 comprises a control box 160 connected to the hydraulic system. The control box 160 comprises a series of command levers connected to control valves (not shown) that are connected to the different hydraulic actuators (hydraulic linear actuators 126 and 138 and the hydraulic rotary actuator of the brush assembly) that allow an operator, by operating the command levers, to power the hydraulic actuators, thereby to power up the brush shaft and to modify the orientation and position of the arm 130.

It should be noted that hydraulic linear actuators 126 and 138 and the hydraulic rotary actuator of the brush assembly can also be replaced by other actuators, and can be hydraulic cylinders or other types of actuator such as electric linear motors.

Figure 19:
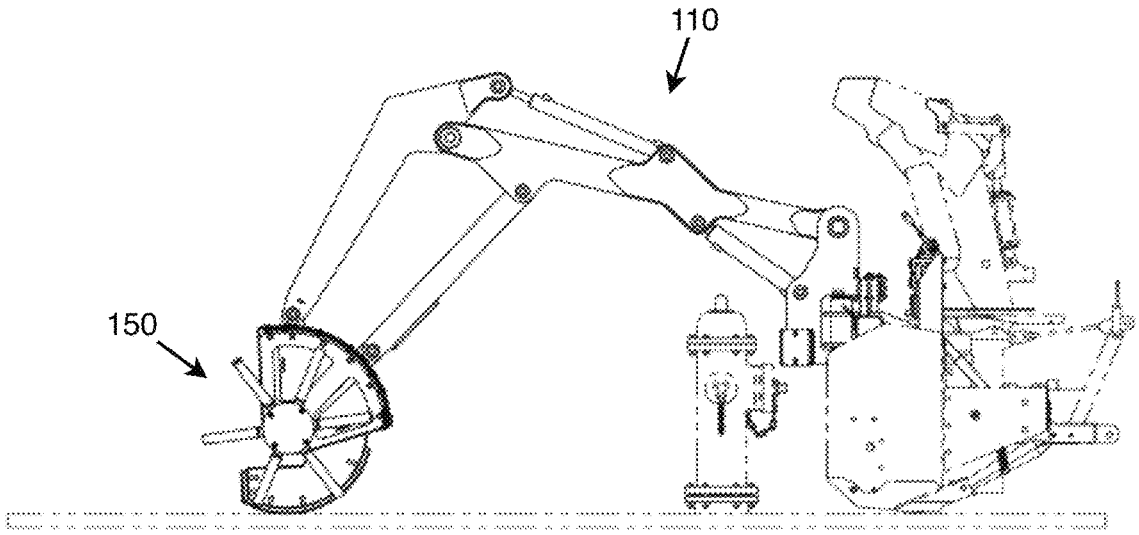
Figure 20:
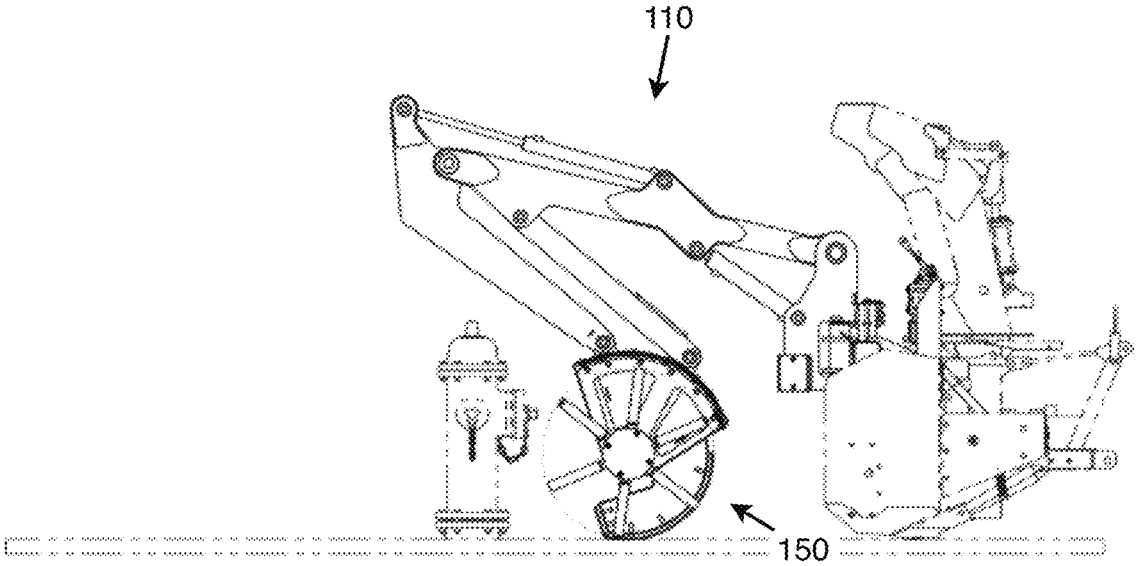
Figure 21:
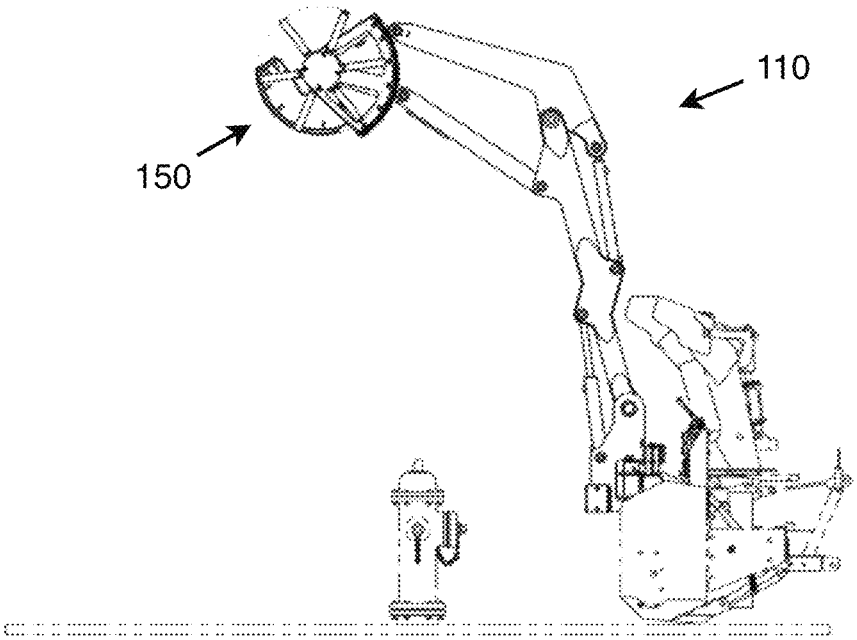
Figure 22:
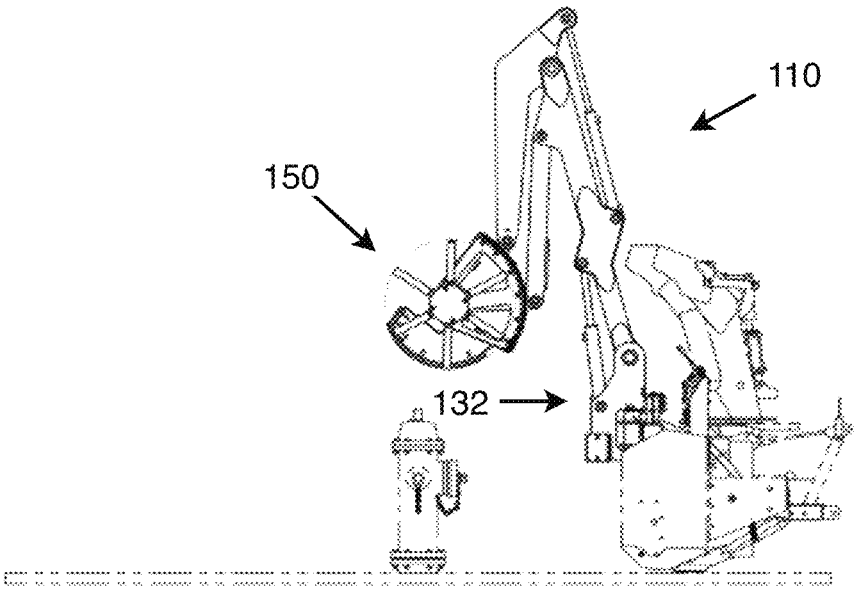
Figure 23:
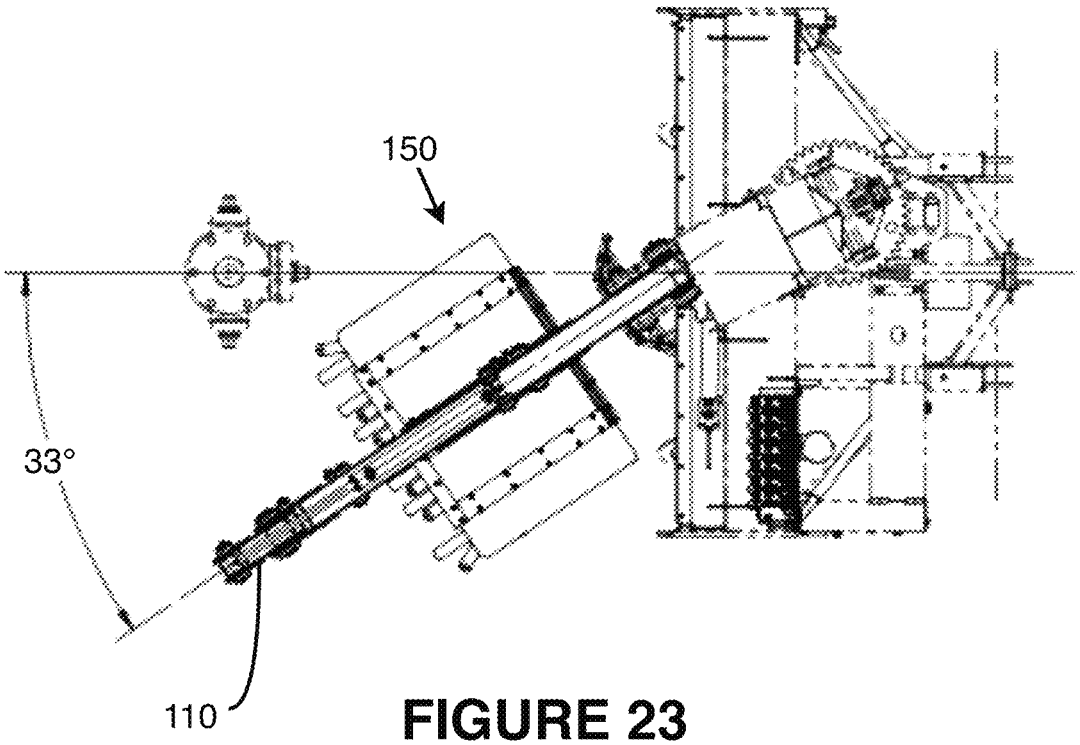
FIGS. 23 and 24 are top views of the sweeping machine of FIGS. 8 to 10 with the arm depicted in its two limit orientations.
Figure 24:
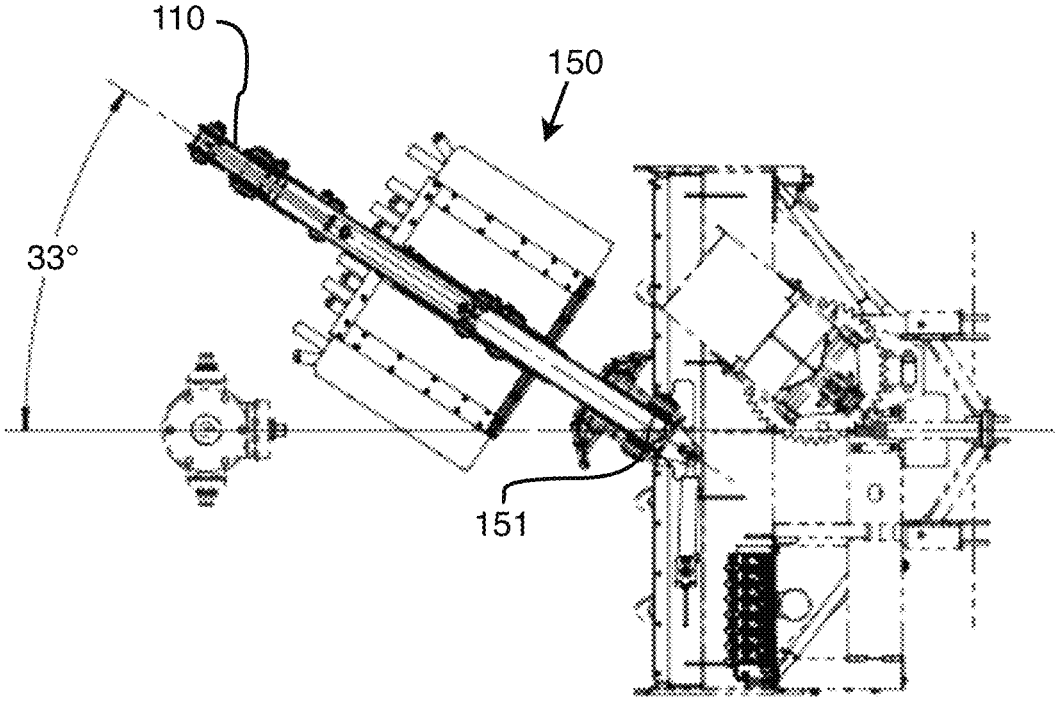

Referring now to FIGS. 17 to 22, the sweeping machine 110 is adapted to sweep debris from the area around an obstacle with the brush assembly 150 being able to clear the front of the obstacle at different elevations (see FIGS. 20 and 22) and to clean beyond the obstacle with the arm extending above the obstacle (see FIGS. 19 and 21). FIGS. 23 and 24 show the arm being removed from beyond the obstacle, first the arm 130 being elevated with the brush assembly 150 above the obstacle, and afterward the arm 130 folding with the brush assembly 150 moving toward the mount end 132 of the arm 130.

Referring now to FIGS. 23 and 24, the sweeping machine 110 is further able to clean the area left and right of the obstacle without having to move the vehicle 25 by swiveling the arm 130 left or right (up to an angle of about 33 (thirty-three) degrees from the longitudinal central axis of the vehicle 25) and operating the arm 130 in the positions depicted on FIGS. 19 to 24 as intermediary positions (not depicted).

Figure 25:
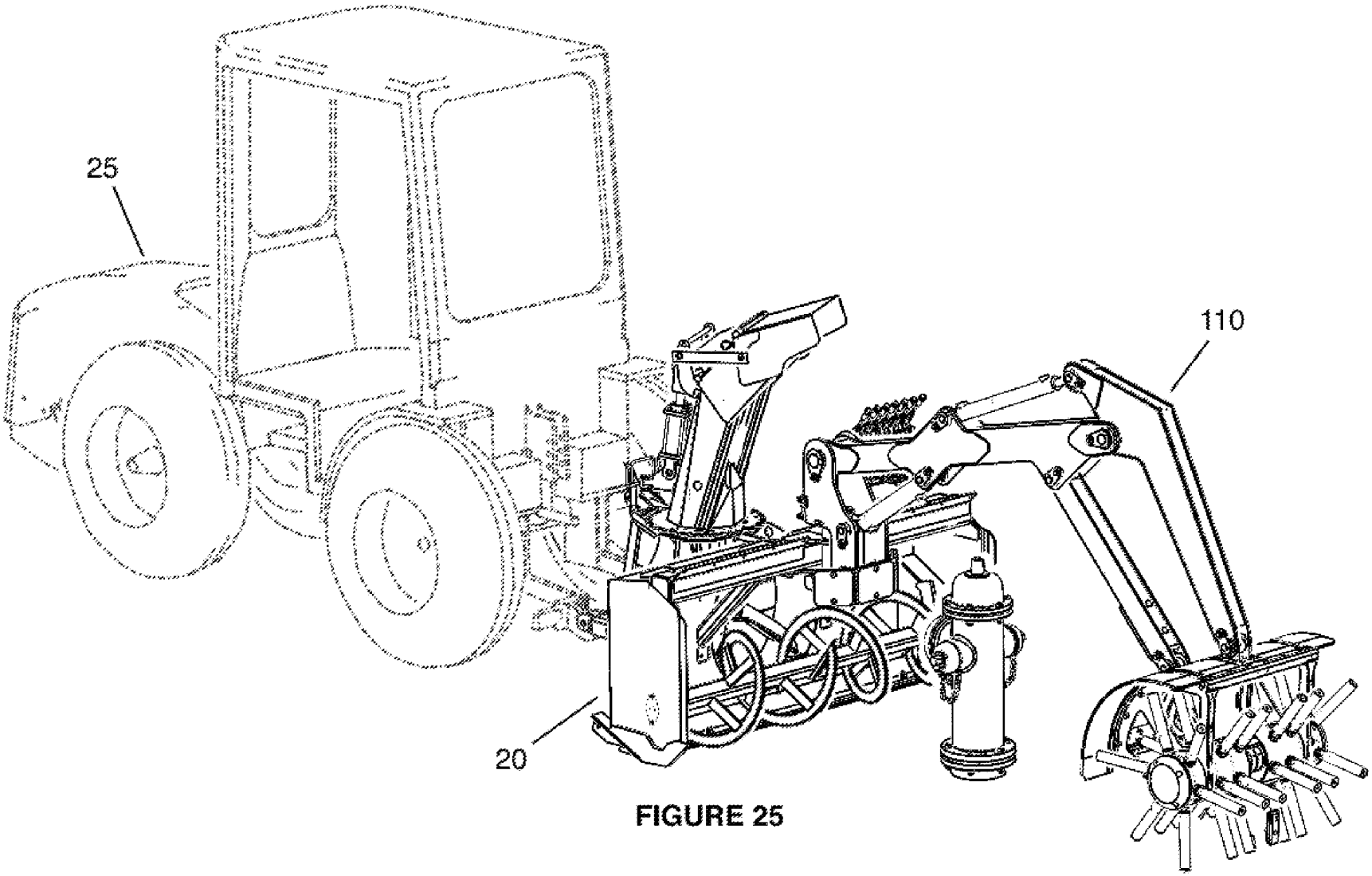
FIG. 25 is a picture of the sweeping machine during the operation of cleaning an area from snow around a fire hydrant.

According to that structure, the sweeping machine 110 can clean a minimum radius of about 1,5 meter around the obstacle with minimal displacement of the vehicle 25. The combination sweeping machine 110 and blower 20 is further able to sweep debris from the area around an obstacle and to blow the removed debris away from the area with the blower 20 by controlling the direction and distance where the debris removed from the area are projected by the blower 20. Finally, with fine control of the position and of the angle of the brush assembly 150, the operator can perform the operation of cleaning the area around an obstacle even when a second obstacle such as a utility pole is present in the area. The picture of FIG. 25 illustrates an embodiment of the sweeping machine 110 is in operation cleaning the area around a fire hydrant from snow, with the snow being projected forward away from the fire hydrant.

The use of a control box 160 located on the top of the blower 20 further allows the operator to optionally have a closer view of the area around the obstacle to operating more finely the sweeping machine 110 in the area.

Method of operation of the sweeping machine 10 or 110 for sweeping debris from an area around an obstacle, therefore, comprises the following steps:

A first step consists in providing an assembly comprising a blower and a rotating brush secured thereto, wherein the rotating brush has an axis of rotation which is horizontal.

The following step consists in holding the rotating brush using an arm, the rotating brush is secured at a distal end thereof.

The following step consists in moving the rotating brush up or down by swiveling the arm about a proximal end thereof.

The following step consists in rotating the rotating brush to sweep debris from the area around the obstacle toward the blower.

The following step consists in moving the rotating brush horizontally by swiveling the arm horizontally about a proximal end thereof while rotating the rotating brush to further sweep the area around the obstacle.

A final step consists in blowing the debris swept off from the area away from the obstacle.

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A sweeping machine for sweeping debris from an area around an obstacle, comprising:

a blower comprising a structure and a mouth for receiving the debris;

a brush assembly comprising a rotating brush having an operative axis of rotation which is horizontal and which, in use, is configured to be able to direct the debris at least toward the mouth of the blower;

an articulated arm having a proximal end and a distal end to which the brush assembly is secured, the articulated arm comprising a plurality of sub-arms comprising:

a first sub-arm comprising the proximal end;

a second sub-arm rotatably mounted to the first sub-arm;

a third sub-arm rotatably mounted to the first sub-arm, the second sub-arm and the third sub-arm combined comprising the distal end of the articulated arm;

a first linear actuator connected to the first sub-arm; and a second linear actuator controlling rotation of the second sub-arm and the third sub-arm relative to the first sub-arm, wherein the plurality of sub-arms are rotatably cooperating with each other to independently control elevation and distance of the brush assembly; and a pivoting mechanism comprising an orienting actuator and a mount component secured to the structure of the blower and to which the arm is mounted, the mount component being mounted to the structure of the blower to which the proximal end of the articulated arm is mounted with the mount component being rotatable about a vertical axis, wherein, in use, the pivoting mechanism swivels the arm about a first horizontal axis thereby lifting or lowering the brush assembly and swivels the arm about the vertical axis to move the brush assembly within a horizontal plane while remaining operable to direct the debris at least toward the mouth of the blower.

2. The sweeping machine of claim 1, wherein the second sub-arm and the third sub arm are connected to the brush assembly.

3. The sweeping machine of claim 2, wherein the second linear actuator is connecting the second sub-arm to the first sub-arm to swivel of the second sub-arm about a second horizontal axis thereby lifting or lowering the brush assembly.

4. The sweeping machine of claim 1, wherein the brush assembly further comprises a frame on which the rotating brush is rotatably mounted and wherein the frame comprises a skirt for deflecting the debris swept from the area toward the blower.

5. The sweeping machine of claim 1, wherein the brush assembly further comprises a frame on which the rotating brush is rotatably mounted and wherein the frame comprises a skid contacting a ground surface before the rotating brush upon the rotating brush being lowered about the ground surface.

6. The sweeping machine of claim 5, wherein the rotating brush comprises two opposite ends in a horizontally direction and further wherein the skid is located substantially at an equal distance between the two opposite ends.

7. The sweeping machine of claim 1, wherein the rotating brush comprises a hydraulic rotary actuator drivable in two directions.

8. The sweeping machine of claim 1, wherein the rotating brush comprises a brush shaft and bristles, wherein the bristles extend radially from the brush shaft.

9. The sweeping machine of claim 8, wherein the bristles are made of at least one of rubber, polypropylene and steel wires.

10. The sweeping machine of claim 8, wherein the bristles are secured around the brush shaft in a number of rows which is between 5 and 10.

11. The sweeping machine of claim 1, further comprising a control box mounted to the blower, wherein the control box controls orientation and position of the arm, and power transmitted to the rotating brush.

12. The sweeping machine of claim 1, wherein the orienting actuator of the pivoting mechanism is a hydraulic linear actuator to enable the swivel of the arm about the vertical axis to move the brush assembly within the horizontal plane.

13. The sweeping machine of claim 1, wherein, in use, the pivoting mechanism further swivels the arm about a second horizontal axis to extend or retract the brush assembly.

14. The sweeping machine of claim 1, wherein the first sub-arm, the second sub-arm and the third sub-arm are each rotatable around axes that are parallel to each other.

15. A sweeping machine to be secured to a structure of a blower comprising a mouth, the sweeping machine being configured for sweeping debris from an area around an obstacle, comprising:

a brush assembly comprising a rotating brush having an operative axis of rotation which is horizontal when sweeping debris;

an articulated arm having a proximal end and a distal end to which the brush assembly is secured, the articulated arm comprising a plurality of sub-arms comprising:

a first sub-arm comprising the proximal end;

a second sub-arm rotatably mounted to the first sub-arm;

a third sub-arm rotatably mounted to the first sub-arm, the second sub-arm and the third sub-arm combined comprising the distal end of the articulated arm;

a first linear actuator connected to the first sub-arm; and a second linear actuator controlling rotation of the second sub-arm and the third sub-arm relative to the first sub-arm, wherein the plurality of sub-arms are rotatably cooperating with each other to independently control elevation and distance of the brush assembly; and a pivoting mechanism comprising an orienting actuator and a mount component securable to the structure of the blower and to which the arm is mounted, wherein, in use, the pivoting mechanism swivels the arm about a horizontal axis thereby lifting or lowering the brush assembly and swivels the arm about a vertical axis to move the brush assembly within a horizontal plane, wherein the sweeping machine is operable to sweep debris from the area around the obstacle toward the mouth of the blower.

16. The sweeping machine of claim 15, wherein the plurality of sub-arms are pivotally mounted to each other whereby the sub-arms are movable between a plurality of positions relative to each other.

17. The sweeping machine of claim 16, wherein the distal end of the arm comprises two sub-arms connected to the brush assembly.

18. The sweeping machine of claim 15, wherein the brush assembly further comprises a frame on which the rotating brush is rotatably mounted and wherein the frame comprises a skid contacting a ground surface upon the rotating brush being lowered about the ground surface.

19. The sweeping machine of claim 15, wherein the first sub-arm, the second sub-arm and the third sub-arm are each rotatable around axes that are parallel to each other.

20. A sweeping machine to be secured to a structure of a blower comprising a mouth, the sweeping machine being configured for sweeping debris from an area around an obstacle, comprising:

a brush assembly comprising a rotating brush having an operative axis of rotation which is horizontal when sweeping debris;

an articulated arm having a proximal end and a distal end to which the brush assembly is secured, the articulated arm comprising:

a first sub-arm comprising the proximal end;

a second sub-arm rotatably mounted to the first sub-arm;

a third sub-arm rotatably mounted to the first sub-arm, the second sub-arm and the third sub-arm combined comprising the distal end of the articulated arm;

the articulated sub arms rotatably cooperating with each other to extend and retract the brush assembly relative to the blower in a plane perpendicular to the operative axis of rotation of the rotating brush; and a control mechanism comprising:

a first linear actuator connected to the first sub-arm; and a second linear actuator controlling rotation of the second sub-arm and the third sub-arm relative to the first sub-arm, and a mount component securable to the structure of the blower and to which the arm is mounted, wherein, in use, the control mechanism being designed to:

swivels the arm about a horizontal axis thereby allowing lifting and lowering the brush assembly; and swivels the arm about a vertical axis to move the brush assembly within a horizontal plane, wherein the brush assembly is able to a) sweep the debris from the area around the obstacle toward the mouth of the blower when the pivoting mechanism swivels the arm about the horizontal axis, b) swivels the arm about a second horizontal axis, and c) swivels the arm about the vertical axis.

* * * * *